US008851844B2

(12) United States Patent
Yamashita et al.

(10) Patent No.: US 8,851,844 B2
(45) Date of Patent: Oct. 7, 2014

(54) STATIONARY BLADE AND STEAM TURBINE

(75) Inventors: Hiroyuki Yamashita, Takasago (JP); Yasutomo Kaneko, Takasago (JP); Hiroharu Ooyama, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1182 days.

(21) Appl. No.: 12/666,022

(22) PCT Filed: Oct. 24, 2008

(86) PCT No.: PCT/JP2008/069373

§ 371 (c)(1),
(2), (4) Date: Dec. 22, 2009

(87) PCT Pub. No.: WO2009/057532

PCT Pub. Date: May 7, 2009

(65) Prior Publication Data

US 2010/0329847 A1 Dec. 30, 2010

(30) Foreign Application Priority Data

Oct. 31, 2007 (JP) ..... 2007-282812

(51) Int. Cl.

| | |
|---|---|
| ***F01D 5/16*** | (2006.01) |
| ***F01D 5/18*** | (2006.01) |
| ***F01D 25/32*** | (2006.01) |
| ***F01D 9/04*** | (2006.01) |

(52) U.S. Cl.

CPC ..... *F01D 9/041* (2013.01); *F05D 2220/31* (2013.01); *F01D 5/16* (2013.01); *Y10S 416/50* (2013.01)

USPC ..... 416/96 A; 415/169.3; 415/169.4; 416/224; 416/500

(58) Field of Classification Search

USPC ..... 415/169.2, 169.3, 169.4; 416/96 A, 140, 416/190, 500

See application file for complete search history.

(56) References Cited

U.S. PATENT DOCUMENTS

| | | | |
|---|---|---|---|
| 2,801,073 | A | 7/1957 | Savage |
| 2,873,944 | A | 2/1959 | Wiese et al. |

(Continued)

FOREIGN PATENT DOCUMENTS

| | | |
|---|---|---|
| JP | 64-32004 | 2/1989 |
| JP | 3-47403 | 2/1991 |

(Continued)

OTHER PUBLICATIONS

International Search Report issued Dec. 22, 2008 in International (PCT) Application No. PCT/JP2008/069373.

*Primary Examiner* — Edward Look
*Assistant Examiner* — Jason Davis
(74) *Attorney, Agent, or Firm* — Wenderoth, Lind & Ponack, LLP

(57) ABSTRACT

A stationary blade and a steam turbine capable of reducing self-excited vibrations with a simple configuration are provided. A stationary blade has a cavity, extending in a blade-width direction, formed therein and slits communicating between the cavity and the outside. A wave-shaped plate spring that is in sliding contact with at least one of a pressure-side member and a suction-side member is provided between the pressure-side member, which is a portion on the pressure side of the cavity, and the suction-side member, which is a portion on the suction side of the cavity. When the stationary blade is elastically deformed, the wave-shaped plate spring causes friction between itself and at least one of the pressure-side member and the suction-side member. This friction attenuates relative positional displacement between the pressure-side member and the suction-side member. Thus, self-excited vibrations occurring at the stationary blade can be reduced.

14 Claims, 22 Drawing Sheets

(56) References Cited

U.S. PATENT DOCUMENTS

| | | | | | |
|---|---|---|---|---|---|
| 2,920,866 | A * | 1/1960 | Francis | 416/92 | |
| 3,475,107 | A | 10/1969 | Auxier | | |
| 3,566,493 | A * | 3/1971 | Poucher et al. | 29/889.71 | |
| 4,897,021 | A | 1/1990 | Chaplin et al. | | |
| 5,056,738 | A * | 10/1991 | Mercer et al. | 244/54 | |
| 5,284,011 | A * | 2/1994 | Von Benken | 60/796 | |
| 5,346,362 | A | 9/1994 | Bonner et al. | | |
| 6,305,902 | B1 * | 10/2001 | Konishi et al. | 415/115 | |
| 2007/0231122 | A1 | 10/2007 | Tsuru et al. | | |

FOREIGN PATENT DOCUMENTS

| | | |
|---|---|---|
| JP | 4-179802 | 6/1992 |
| JP | 5-14503 | 2/1993 |
| JP | 9-209708 | 8/1997 |
| JP | 2877837 | 1/1999 |
| JP | 11-336503 | 12/1999 |
| JP | 3461562 | 8/2003 |
| JP | 2005-315076 | 11/2005 |

* cited by examiner

STATIONARY BLADE AND STEAM TURBINE

BACKGROUND OF THE INVENTION

1. Technical Field

The present invention relates to stationary blades used in a steam turbine, and, more specifically, it relates to an internal structure of stationary blades and a steam turbine including the stationary blades having such an internal structure.

2. Description of the Related Art

In recent years, in order to reduce the weight of steam turbines, a technique for forming cavities in stationary blades, i.e., a hollow structure, has been known. Furthermore, in order to improve the performance, a technique has been proposed in which slits communicating between cavities of stationary blades and the outside are provided to introduce water droplets deposited on the surface of the stationary blades into the cavities to remove them (for example, see Japanese Unexamined Patent Application, Publication No. Hei 11-336503). The water taken into the cavities flows toward a shroud bonded to the stationary blades and is discharged therefrom.

Such steam turbine stationary blades sometimes cause self-excited vibrations (flutter) depending on the exterior shape (geometrical shape) and mass thereof and the environment around the stationary blades (for example, the flow rate and mass of the steam passing through the stationary blades) while the turbine is operated. In particular, it is known that the self-excited vibrations tend to occur when the mass of the stationary blades is small and when the blade width (the entire length of the blades) is large.

To reduce such self-excited vibrations, a technique for attenuating vibrations occurring at the stationary blades by providing attenuation mechanisms (dampers) at bonding portions of the stationary blades and the shroud has been proposed (for example, see Japanese Patent No. 3461562 and Japanese Patent No. 2877837).

SUMMARY OF THE INVENTION

Meanwhile, the above-described stationary blades having cavities therein (hereinafter referred to as "hollow stationary blades") are lower in weight than solid stationary blades having no cavities therein (hereinafter referred to as "solid stationary blades"). Therefore, the hollow stationary blades are more likely to cause self-excited vibrations than the solid stationary blades, and they needs to be reduced.

However, from the standpoint of the design structure, application of the above-mentioned attenuation mechanisms to a steam turbine employing hollow stationary blades is extremely difficult. For example, if attenuation mechanisms as disclosed in Patent Documents 1 and 2 are to be provided at bonding portions of the hollow stationary blades and the shroud, the attenuation mechanisms will block the cavities extending from the hollow stationary blades to the shroud, leading to a problem in that the water taken into the cavities cannot be appropriately discharged to the shroud.

The present invention has been made in view of the above-described circumstances, and an object thereof is to provide stationary blades capable of reducing self-excited vibrations with a simple configuration and to provide a steam turbine.

To achieve the above-described object, a stationary blade according to a first aspect of the present invention is a stationary blade used in a steam turbine, having a cavity formed therein and having a slit formed for communicating between the cavity and the outside. The stationary blade includes a sliding-contact member capable of contacting a blade inner face from the cavity in a slidable manner.

A stationary blade according to a second aspect of the present invention is the above-described stationary blade, including a pressure-side portion, which is a portion on the pressure side of the cavity, and a suction-side portion, which is a portion on the suction side of the cavity. The sliding-contact member is provided between the pressure-side portion and the suction-side portion and is in contact with at least one of the pressure-side portion and the suction-side portion.

A stationary blade according to a third aspect of the present invention is the above-described stationary blade, in which the sliding-contact member is an urging member that urges the pressure-side portion and the suction-side portion outward in a blade-thickness direction.

A stationary blade according to a fourth aspect of the present invention is the above-described stationary blade, in which the urging member is a plate-like spring member that has a plate shape extending in a blade-width direction and presses the pressure-side portion and the suction-side portion with an elasticity caused by distortion.

A stationary blade according to a fifth aspect of the present invention is the above-described stationary blade, in which the plate-like spring member has a wave-shaped cross section and is in contact with the pressure-side portion and the suction-side portion at crests of the wave shape.

A stationary blade according to a sixth aspect of the present invention is the above-described stationary blade, in which the plate-like spring member has a substantially C-shaped cross section and is in contact with one of the pressure-side portion and the suction-side portion at open-end portions of the C shape and is in contact with the other at a base portion of the C shape.

A stationary blade according to a seventh aspect of the present invention is the above-described stationary blade, in which the plate-like spring member has a bow-shaped cross section and is in contact with one of the pressure-side portion and the suction-side portion at end portions of the bow shape and is in contact with the other at a base portion of the bow shape.

A stationary blade according to an eighth aspect of the present invention is the above-described stationary blade, in which two plate-like spring members having a bow-shaped cross section are disposed in the blade-thickness direction, and rear faces of base portions of the plate-like spring members are in sliding contact with each other.

A stationary blade according to a ninth aspect of the present invention is the above-described stationary blade, in which an end portion of the plate-like spring member has a divided structure or a slit structure in which the end portion is divided into a plurality of plates in a plate-thickness direction.

A stationary blade according to a tenth aspect of the present invention is the above-described stationary blade, in which the plate-like spring member has an angular U-shaped cross section and is in contact with the pressure-side portion and the suction-side portion at arm portions of the angular U shape.

A stationary blade according to an eleventh aspect of the present invention is the above-described stationary blade, in which the pressure-side portion and the suction-side portion are bonded to each other at a front edge and a rear edge, and the plate-like spring member is bonded to one of the pressure-side portion and the suction-side portion.

A stationary blade according to a twelfth aspect of the present invention is the above-described stationary blade, in which, among cavities divided by the plate-like spring member, a cavity not communicating with the outside via a slit is provided with a damping material.

A stationary blade according to a thirteenth aspect of the present invention is the above-described stationary blade, including a plate-like partition wall provided substantially perpendicular to a mean camber line of the blade to divide the cavity formed therein into a front-edge-side cavity and a rear-edge-side cavity. The rear-edge-side cavity is filled with a damping material.

A steam turbine according to a fourteenth aspect of the present invention is a steam turbine in which the above-described stationary blades are arranged at predetermined intervals in a circumferential direction of a rotor shaft.

A steam turbine according to a fifteenth aspect of the present invention is the above-described steam turbine, in which solid stationary blades are arranged in a mixed manner.

A steam turbine according to a sixteenth aspect of the present invention is the above-described steam turbine, in which the above-described stationary blades and the solid stationary blades are alternately arranged.

A steam turbine according to a seventeenth aspect of the present invention is the above-described steam turbine, in which a plurality of types of stationary blades having different natural frequencies are arranged.

In the stationary blade according to the first aspect of the present invention, because a sliding-contact member capable of contacting the blade inner faces from the cavity in a slidable manner is provided, when the stationary blade is elastically deformed, the sliding-contact member comes into sliding contact with the blade inner faces from the cavity, producing friction between itself and the blade inner faces. By attenuating the elastic deformation of the stationary blade with this friction, self-excited vibrations occurring at the stationary blade can be reduced.

In the stationary blade according to the second aspect of the present invention, because the sliding-contact member is provided between the pressure-side portion and the suction-side portion and is made to be in contact with at least one of the pressure-side portion and the suction-side portion, when the stationary blade is elastically deformed, friction is produced between the sliding-contact member and at least one of the pressure-side portion and the suction-side portion. Relative positional displacement occurring between the pressure-side portion and the suction-side portion can be attenuated with this friction. Thus, self-excited vibrations occurring at the stationary blade can be reduced.

In the stationary blade according to the third aspect of the present invention, because the sliding-contact member is made to be an urging member that urges the pressure-side portion and the suction-side portion outward in the blade-thickness direction, when relative positional displacement occurs between the pressure-side portion and the suction-side portion, the urging member can produce a kinetic frictional force having a magnitude corresponding to this urging force between itself and at least one of the pressure-side portion and the suction-side portion. By selecting the rigidity of the urging member and adjusting the urging force when being disposed in the cavity (initial state), the properties of attenuating positional displacement between the pressure-side portion and the suction-side portion can be set to desired properties.

In the stationary blade according to the fourth aspect of the present invention, because the urging member is made to be a plate-like spring member which has a plate shape and presses the pressure-side portion and the suction-side portion with the elasticity caused by distortion, merely by curving a rectangular plate-like member in the width direction by pressing or the like, an urging member extending in the longitudinal direction of the plate-like spring member, i.e., the blade-width direction of the stationary blade, can be realized.

In the stationary blade according to the fifth aspect of the present invention, because the plate-like spring member is made to have a wave-shaped cross section, it can be in contact with the pressure-side portion or the suction-side portion at a plurality of crests of the wave shape in a slidable manner. Thus, appropriate friction can be produced between itself and the pressure-side portion or the suction-side portion.

In the stationary blade according to the sixth aspect of the present invention, because the plate-like spring member is made to have a C-shaped cross section, the plate-like spring member can be in sliding contact with the pressure-side portion or the suction-side portion over a sufficient area. Thus, appropriate friction can be produced between itself and the pressure-side portion or the suction-side portion. Merely by curving a flat plate-like member into a round shape in the width direction, the plate-like spring member can be easily realized.

In the stationary blade according to the seventh aspect of the present invention, because the plate-like spring member is made to have a bow-shaped cross section, the plate-like spring member can be in sliding contact with the pressure-side portion or the suction-side portion over a sufficient area. Thus, appropriate friction can be produced between itself and the pressure-side portion or the suction-side portion. Merely by forming a smooth peak fold and valley fold at two positions on a flat plate-like member, the plate-like spring member can be easily realized.

In the stationary blade according to the eighth aspect of the present invention, because friction can be produced by allowing the rear faces of the base portions to be in sliding contact with each other, the end portions of the plate-like spring members can be fixed to the suction-side portion or the pressure-side portion by, for example, welding. Thus, uneven contact between the end portions and the suction-side portion and uneven contact between the end portions and the pressure-side member caused by the dimensional tolerance of the plate spring and the dimensional tolerance of the blade (pressure-side portion and suction-side portion) can be assuredly prevented.

Note that uneven contact between the rear faces of the base portions can be avoided by appropriately selecting the material of the plate-like spring members (by selecting such a material that the rear faces are not unevenly in contact with each other).

In the stationary blade according to the ninth aspect of the present invention, when the stationary blade is elastically deformed, frictional attenuation is produced between the divided plates. This can further attenuate relative positional displacement between the pressure-side portion and the suction-side portion and can further reduce self-excited vibrations occurring at the stationary blade.

In the stationary blade according to the tenth aspect of the present invention, because the plate-like spring member is made to have an angular U-shaped cross section, the plate-like spring member can be made compact and can be easily disposed in the cavity. Merely by bending a flat plate-like member at two positions, the plate-like spring member can be easily realized.

In the stationary blade according to the eleventh aspect of the present invention, because the plate-like spring member is made to be bonded to one of the pressure-side portion and the suction-side portion, the plate-like spring member can be fixed to a desired position in the cavity. Thus, the occurrence of variation in the properties of attenuating positional displacement between the pressure-side portion and the suction-side portion can be reduced.

In the stationary blade according to the twelfth aspect of the present invention, because a cavity not communicating with the outside via a slit is provided with a damping material, relative positional displacement between the pressure-side member and the suction-side member can be attenuated with deformation resistance of the damping material.

In the stationary blade according to the thirteenth aspect of the present invention, the rear-edge-side cavity divided by the partition plate is filled with a damping material. Relative positional displacement between the pressure-side portion and the suction-side portion can be attenuated using deformation resistance of the damping material.

Furthermore, because the rear-edge-side cavity is filled with the damping material instead of the plate-like spring member, uneven contact of the plate spring caused by the dimensional tolerance of the plate spring and the dimensional tolerance of the blade (the pressure-side portion and the suction-side portion) can be prevented.

In the steam turbine according to the fourteenth aspect of the present invention, because the above-described stationary blades are arranged at predetermined intervals in a circumferential direction of a rotor shaft, self-excited vibrations can be reduced by arranging hollow stationary blades, which are less likely to cause self-excited vibrations (flutter) than solid stationary blades, in the blade group in the same stage.

In the steam turbine according to the fifteenth aspect of the present invention, because the solid stationary blades are arranged in a mixed manner, it is possible to arrange stationary blades having a great difference in natural frequency next to each other without varying the exterior shape of the stationary blades. Thus, self-excited vibrations occurring due to stationary blades having substantially the same natural frequencies being arranged next to each other in the blade group in the same stage can be reduced.

In the steam turbine according to the sixteenth aspect of the present invention, because the above-described stationary blades and the solid stationary blades are alternately arranged, it can be ensured that the stationary blades next to each other in the blade group in the same stage have different natural frequencies. Thus, self-excited vibrations occurring due to stationary blades having substantially the same natural frequencies being arranged next to each other can be further reduced.

In the steam turbine according to the seventeenth aspect of the present invention, because stationary blades having different natural frequencies are arranged, as many as possible of the hollow stationary blades capable of taking the moisture deposited on the blade surface into the cavity and removing it can be arranged in the blade group in the same stage. Thus, self-excited vibrations occurring due to stationary blades having substantially the same natural frequencies being arranged next to each other can be reduced, and the performance of the steam turbine can be improved.

EXPLANATION OF REFERENCE SIGNS

Figure 1:
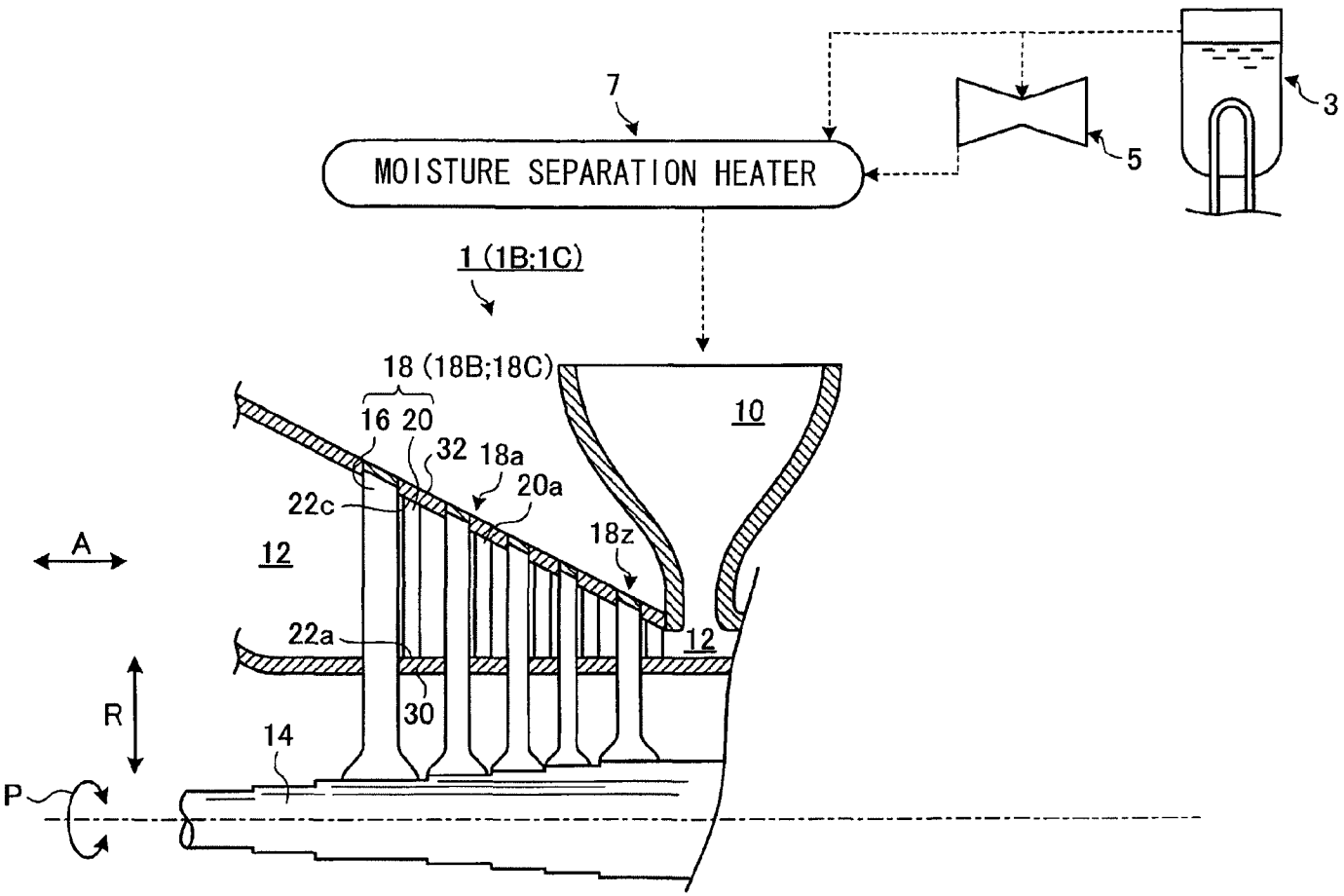
FIG. 1 is a diagram schematically showing, in outline, the configuration of a steam turbine according to a first embodiment.

1, 1B, 1C: steam turbine
18, 18B, 18C: stage
19, 19B, 19C: blade group
20, 20B, 20C, 20D, 20E, 20F, 20G, 20H, 20J, 20K: stationary blades
24: pressure-side face
25: pressure-side member (pressure-side portion)
26: suction-side face
27: suction-side member (suction-side portion)
28*a*, 28*c*: slit
30: inner shroud
32: blade root ring
36: front edge
38: rear edge
40, 40*a*, 40*c*: cavity
44: wave-shaped plate spring (plate-like spring member, urging member, sliding-contact member)
46*a*, 46*c*, 46*e*: front-side crest

48*a*, 48*c*, 48*e*, 48*g*: back-side crest
52: C-shaped plate spring (plate-like spring member, urging member, sliding-contact member)
60: bow-shaped plate spring (plate-like spring member, urging member, sliding-contact member)
70, 72, 74: angular U-shaped plate spring (plate-like spring member, urging member, sliding-contact member)
110: damping material
120: solid stationary blade
130: rib (partition wall)
131: damping material
140: bow-shaped plate spring (plate-like spring member, urging member, sliding-contact member)
141: bow-shaped plate spring (plate-like spring member, urging member, sliding-contact member)
150: bow-shaped plate spring (plate-like spring member, urging member, sliding-contact member)

DETAILED DESCRIPTION OF THE INVENTION

The present invention will be described in detail below with reference to the drawings. Note that these embodiments do not limit the present invention. The components in the following embodiments include those that a person skilled in the art can easily assume or those that are substantially the same.

First Embodiment

Figure 2:
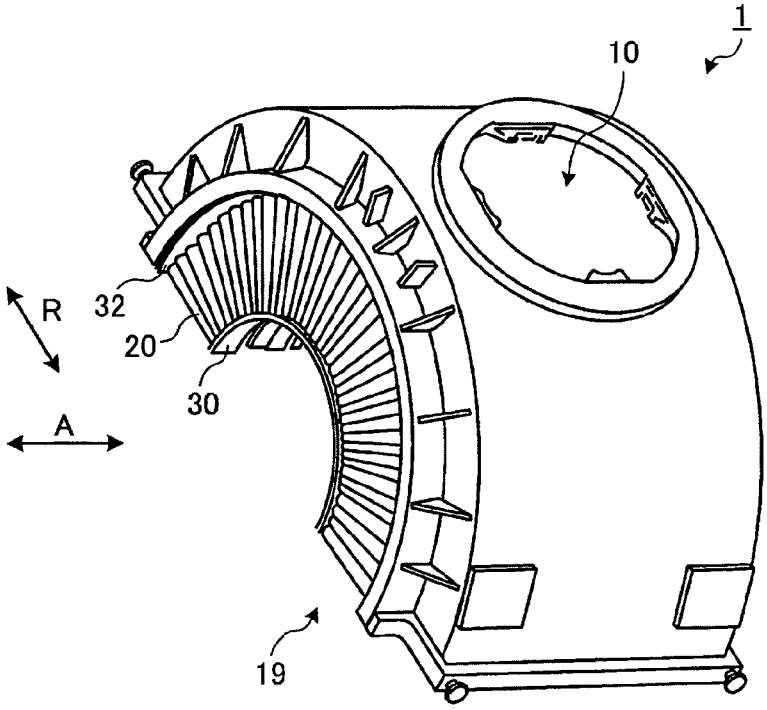
FIG. 2 is an external view of the steam turbine according to the first embodiment, viewed from a low-pressure final stage side.
Figure 3:
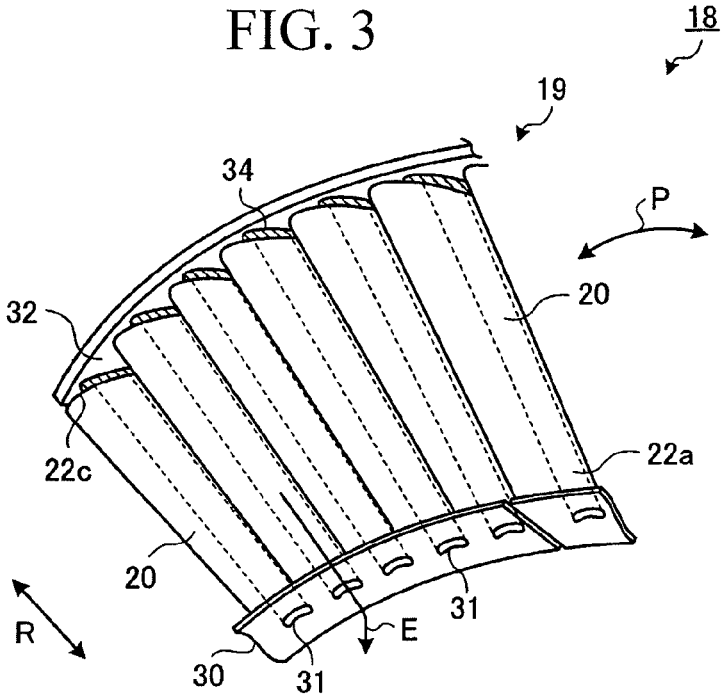
FIG. 3 is an enlarged view of stationary blades shown in FIG. 2, viewed from the suction side.

First, the configuration of a steam turbine according to this example will be described using FIGS. 1 to 3. FIG. 1 is a diagram schematically showing, in outline, the configuration of a steam turbine, FIG. 2 is an external view of the steam turbine viewed from a low-pressure final stage side, and FIG. 3 is an enlarged view of stationary blades shown in FIG. 2, viewed from the suction side.

The steam turbine according to this embodiment is used in a nuclear power plant or the like, and such a plant includes, as shown in FIG. 1, a steam generator 3 that generates high-pressure steam, a high-pressure steam turbine 5 to which the high-pressure steam from the steam generator 3 is directly supplied, a moisture separation heater 7 that separates and heats the moisture of the steam from the steam generator 3 and the high-pressure steam turbine 5, and a low-pressure steam turbine 1 to which low-pressure steam from the moisture separation heater 7 is supplied. In this embodiment, the low-pressure steam turbine 1, to which the steam from the moisture separation heater 7 is supplied, will be described as an embodiment.

In the steam turbine 1, the steam from the moisture separation heater 7 is supplied to a steam inlet 10 and flows through a steam path 12 formed in the steam turbine 1 in the axial direction of a rotor shaft 14 (indicated by an arrow A in the figure). In the steam path 12, moving blades 16 and stationary blades 20 are alternately arranged, and the steam turbine 1 produces kinetic energy by pressure reduction in the stationary blades 20 and converts this into rotational torque by the moving blades 16.

The moving blades 16 are bonded to the rotor shaft 14 and rotationally drive them. On the other hand, as shown in FIGS. 1 to 3, the stationary blades 20 are bonded to a shroud 30 at inner ends 22*a* in the radial direction of the rotor shaft 14 (indicated by an arrow R in the figure) and to a blade root ring 32 at outer ends 22*c* in the radial direction by welding (the welded portions, denoted by reference numeral 34, are shown in FIG. 3).

As shown in FIG. 1, the moving blades 16 and stationary blades 20, forming a pair, constitute a "stage". The steam turbine 1 has many stages 18, 18*a*, . . . , 18*z*. These stages 18, 18*a*, . . . , 18*z* are configured such that the blade widths of the moving blades 16 and stationary blades 20 (the lengths of the blades in the direction substantially perpendicular to the rotor shaft 14) increase from the upstream side toward the downstream side of the steam path 12. The stage 18 located on the most downstream side of the steam path 12 is referred to as a "low-pressure final stage". The blade width of the stationary blades 20 at the low-pressure final stage 18 is particularly larger than that of the stationary blades 20*a* at the stage 18*a* on the upstream side. As shown in FIGS. 2 and 3, in the low-pressure final stage 18, the plurality of stationary blades 20 are arranged at predetermined intervals in the circumferential direction of the rotor shaft 14 (indicated by an arrow P in the figure), forming a blade group 19.

Figure 4:
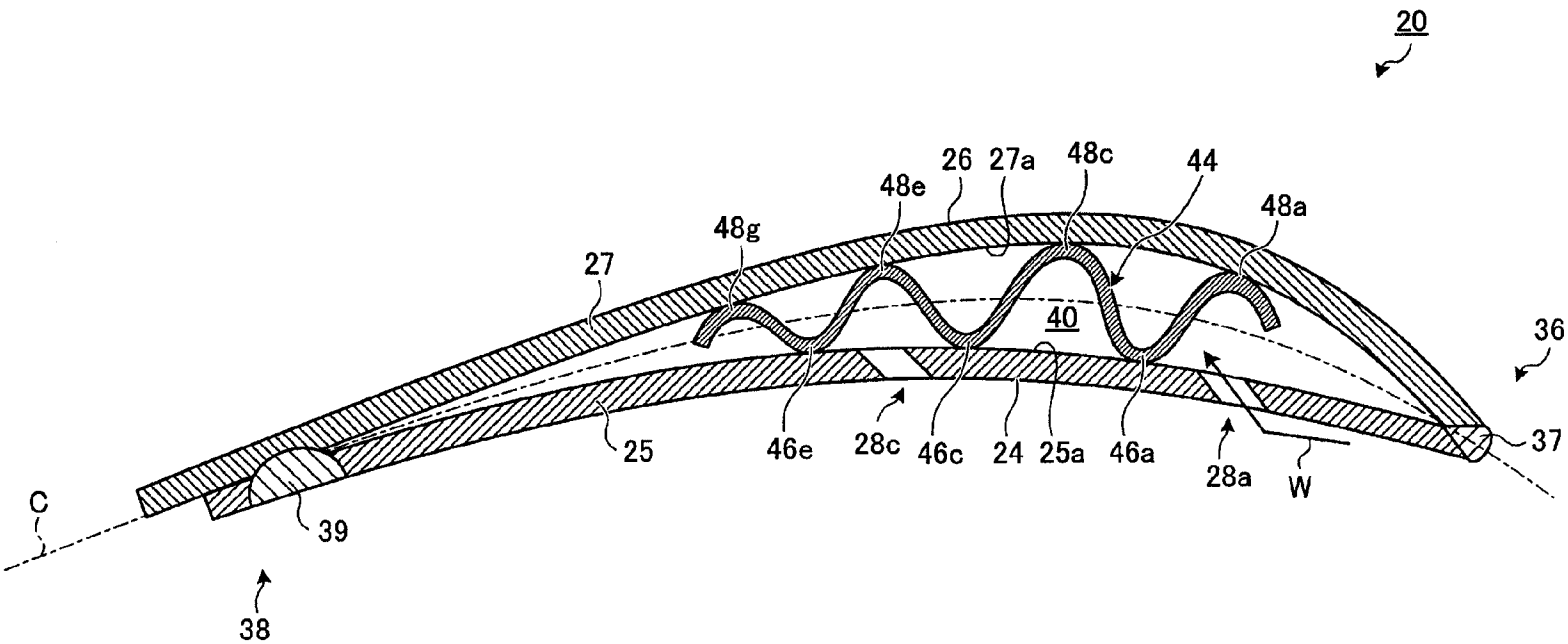
FIG. 4, which is a view showing the blade shape of a stationary blade according to the first embodiment, is a cross section taken along line A-A in FIG. 5.
Figure 5:
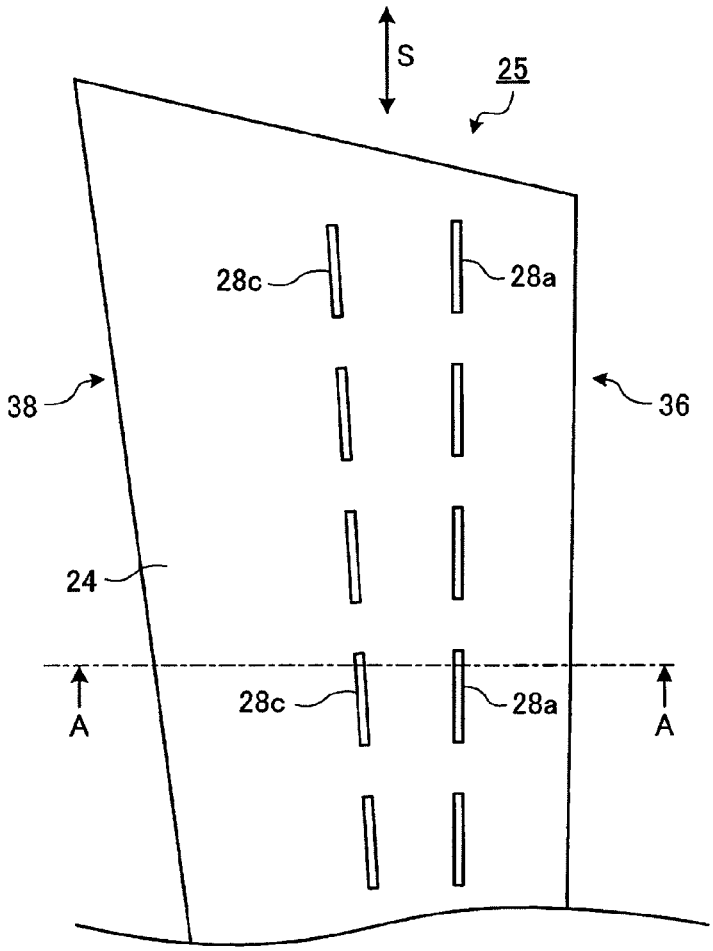
FIG. 5 is a view of the stationary blade according to the first embodiment, viewed from the pressure-side.
Figure 6:
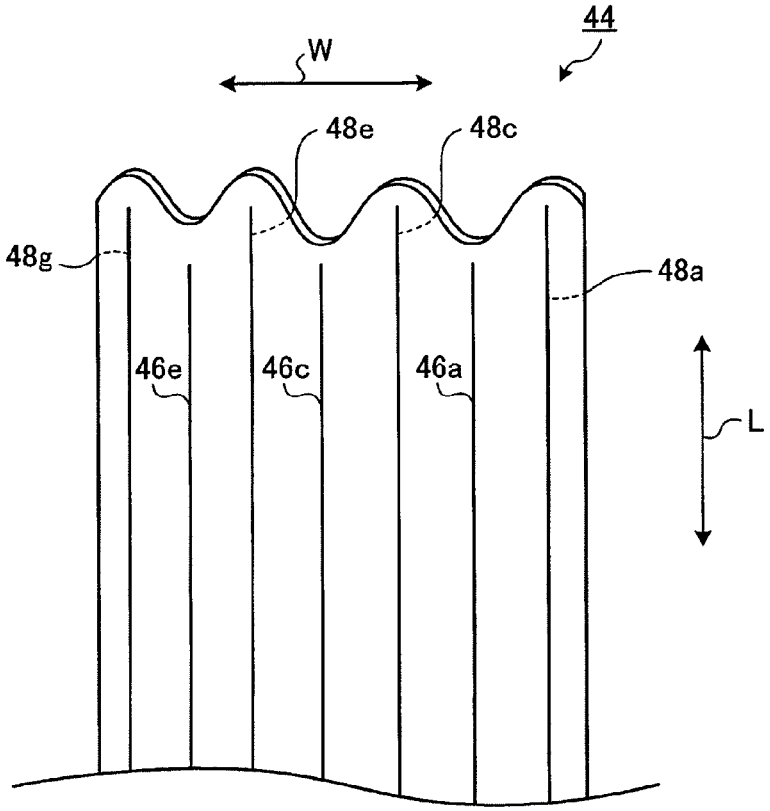
FIG. 6 is a perspective view of a plate-like spring member (wave-shaped plate spring) according to the first embodiment.

Next, the configuration of the stationary blades 20 according to this embodiment will be described using FIGS. 3 to 6. FIG. 4 is a view showing the blade shape of a stationary blade, FIG. 5 is a view of the stationary blade viewed from the pressure-side, and FIG. 6 is a perspective view of a plate-like spring member. Note that FIG. 4 is a sectional view of FIG. 5, taken along line A-A.

As shown in FIG. 4, the stationary blade 20 includes a pressure-side member 25 that mainly constitutes the pressure-side and a suction-side member 27 that mainly constitutes the suction side. The pressure-side member 25 and the suction-side member 27 are formed by curving metal plate-like members so as to have different curves from each other. The pressure-side member 25 is curved such that the surface thereof constitutes a pressure-side face 24 of the stationary blade 20. On the other hand, the suction-side member 27 is curved such that the surface thereof constitutes a suction-side face 26 of the stationary blade 20.

As shown in FIG. 5, the pressure-side member 25 and the suction-side member 27 extend over substantially the same lengths in the blade-width direction (indicated by an arrow S). In addition, the pressure-side member 25 has a plurality of front-edge-side slits 28*a* and rear-edge-side slits 28*c*.

Note that the "blade-width direction" is the direction perpendicular to the sectional plane of the blade shape shown in FIG. 4, i.e., the direction perpendicular to the mean camber line (also referred to as "frame line", indicated by a one-dot chain line C in the figure) of the blade. In this embodiment, the "blade-width direction" is substantially the same as a radial direction R of the rotor shaft 14.

The exterior shape of the stationary blade 20 is formed by assembling the pressure-side member 25 and the suction-side member 27 and connecting them by welding at a front edge 36 and a rear edge 38 (the welded portions are denoted by reference numerals 37 and 39). Thus, the cavity 40 extending in the blade-width direction S is formed in the stationary blade 20, i.e., between a rear face 25*a* of the pressure-side member 25 and a rear face 27*a* of the suction-side member 27. The rear face 25*a* of the pressure-side member 25 and the rear face 27*a* of the suction-side member 27 also form blade inner faces (25*a* and 27*a*) in the stationary blade 20.

Thus, in the stationary blade 20 according to this embodiment, the pressure-side member 25 constitutes a pressure-side portion of the present invention, which is a portion on the pressure side of the cavity 40 of the stationary blade 20, and the suction-side member 27 constitutes a suction-side portion of the present invention, which is a portion on the suction side of the cavity 40 of the stationary blade 20.

The cavity 40 formed in the stationary blade 20 communicates with the outside of the stationary blade 20 through slits

28*a* and 28*c* provided in the pressure-side member 25. In the stationary blade 20 having the cavity 40 and the slits 28*a* and 28*c*, the water deposited on the pressure-side face 24 receives the steam pressure and moves over the pressure-side face 24, for example, as indicated by an arrow W in FIG. 4, and can enter the cavity 40 through the slits 28*a*.

The water taken into the cavity 40 flows in the blade-width direction S toward the shroud 30. As shown in FIG. 3, the shroud 30 has openings 31 communicating with the cavities 40 of the stationary blades 20, and the water in the cavities 40 can be discharged from the openings 31, as indicated by an arrow E.

Such a hollow stationary blade 20 having the cavity 40 therein has a relatively small natural frequency and is more likely to cause self-excited vibrations (flutter) during operation of the steam turbine 1 than a solid stationary blade having no cavity therein. The occurrence of self-excited vibrations distorts and twists the stationary blade 20 due to elastic deformation, causing relative positional displacement between the pressure-side member 25 and the suction-side member 27 of the stationary blades 20.

To attenuate this relative positional displacement, in the stationary blade 20 according to this embodiment, a sliding-contact member capable of contacting the blade inner faces (25*a* and 27*a*) from the cavity 40 in a slidable manner is provided. When the stationary blade 20 is elastically deformed, the sliding-contact member produces friction between itself and the blade inner faces (25*a* and 27*a*). A detailed description will be given below.

As shown in FIG. 4, a wave-shaped plate spring 44 having a wave-shaped cross section and serving as the above-mentioned sliding-contact member is provided between the pressure-side member 25 and the suction-side member 27 in the stationary blade 20 according to this embodiment. The wave-shaped plate spring 44 is in contact with the rear face 25*a* of the pressure-side member 25 at crests 46*a*, 46*c*, and 46*e* on the pressure-side (hereinafter referred to as "front-side crests"). The wave-shaped plate spring 44 is also in contact with the rear face 27*a* of the suction-side member 27 at crests 48*a*, 48*c*, 48*e*, and 48*g* on the rear side (hereinafter referred to as "back-side crests").

As shown in FIG. 6, the wave-shaped plate spring 44 is formed by bending a flat metal plate-like member, extending in the longitudinal direction (indicated by an arrow L in the figure), in the width direction (indicated by an arrow W in the figure) such that peak folds and valley folds are arranged alternately. The wave-shaped plate spring 44 is formed such that the envelope connecting the front-side crests 46*a*, 46*c*, and 46*e* extends along the rear face 25*a* of the pressure-side member 25 and such that the envelope connecting the back-side crests 48*a*, 48*c*, 48*e*, and 48*g* extends along the rear face 27*a* of the suction-side member 27. The wave-shaped plate spring 44, positioned such that the longitudinal direction L agrees with the blade-width direction S of the stationary blade 20, is inserted in the cavity 40 between the pressure-side member 25 and the suction-side member 27.

The wave-shaped plate spring 44, when being disposed in the cavity 40 in this manner (initial state), is formed so as to be slightly elastically deformed by distortion. As shown in FIG. 4, with this elasticity, the wave-shaped plate spring 44 presses the pressure-side member 25 with the front-side crests 46*a*, 46*c*, and 46*e* from the rear face 25*a* and presses the suction-side member 27 with the back-side crests 48*a*, 48*c*, 48*e*, and 48*g* from the rear face 27*a*. That is, the wave-shaped plate spring 44 disposed in the cavity 40 is configured to urge (expand) the pressure-side member 25 and the suction-side member 27 outward in the blade-thickness direction of the stationary blade 20.

Note that the "blade-thickness direction" means the direction parallel to the sectional plane of the blade shape shown in FIG. 4, which is the direction perpendicular to the mean camber line of the blade (indicated by the one-dot chain line C in the figure).

In the thus-configured stationary blade 20, an urging force (pressing force) due to distortion of the wave-shaped plate spring 44 acts between the rear face 25*a* of the pressure-side member 25 and the front-side crests 46*a*, 46*c*, and 46*e* of the wave-shaped plate spring 44 and between the rear face 27*a* of the suction-side member 27 and the back-side crests 48*a*, 48*c*, 48*e*, and 48*g* of the wave-shaped plate spring. When the stationary blade 20 is elastically deformed and causes relative positional displacement between the rear face 25*a* of the pressure-side member 25 and the suction-side member 27, a kinetic frictional force of a magnitude corresponding to the urging force can act.

Next, the function and effect of the stationary blades 20 according to this embodiment will be described using FIG. 4. During operation of the steam turbine 1, the stationary blades 20 may cause self-excited vibrations and may be elastically deformed, depending on the operating conditions thereof. For example, the pressure-side member 25 may be elastically deformed toward the rear edge 38, and the suction-side member 27 may be elastically deformed toward the front edge 36, which may cause relative positional displacement between the rear face 25*a* of the pressure-side member 25 and the rear face 27*a* of the suction-side member 27.

At this time, the wave-shaped plate spring 44 produces a kinetic frictional force in the direction reducing the relative positional displacement between the pressure-side member 25 and the suction-side member 27 at at least one of the gaps between the rear face 25*a* of the pressure-side member 25 and the front-side crests 46*a*, 46*c*, and 46*e* and between the rear face 27*a* of the suction-side member 27 and the back-side crests 48*a*, 48*c*, 48*e*, and 48*g*. This kinetic frictional force attenuates relative positional displacement between the pressure-side member 25 and the suction-side member 27. As a result, self-excited vibrations occurring at the stationary blade can be reduced.

As has been described above, in the stationary blade 20 according to this embodiment, the wave-shaped plate spring 44 serving as a sliding-contact member capable of contacting the blade inner faces from the cavity in a slidable manner is provided. When the stationary blade 20 is elastically deformed, the wave-shaped plate spring 44 contacts the blade inner faces (25*a* and 27*a*) from the cavity 40 in a slidable manner and causes friction between itself and the blade inner faces (25*a* and 27*a*). By attenuating the elastic deformation of the stationary blade 20 with this friction, self-excited vibrations occurring at the stationary blade 20 can be reduced.

In the stationary blade 20 according to this embodiment, the wave-shaped plate spring 44, serving as a sliding-contact member that makes sliding contact with at least one of the pressure-side member 25 and the suction-side member 27 in a slidable manner, is provided between the pressure-side member 25, which is a portion on the pressure side of the cavity 40, and the suction-side member 27, which is a portion on the suction side of the cavity 40. When the stationary blade 20 is elastically deformed, the wave-shaped plate spring 44 causes friction between itself and at least one of the pressure-side member 25 and the suction-side member 27. This friction attenuates relative positional displacement between the pressure-side member 25 and the suction-side member 27.

Furthermore, in the stationary blade 20 according to this embodiment, the wave-shaped plate spring 44 serving as an urging member that urges the pressure-side member 25 and the suction-side member 27 outward in the blade-thickness direction is provided. When the relative positional displacement occurs between the pressure-side member 25 and the suction-side member 27, the wave-shaped plate spring 44 can create a kinetic frictional force of a magnitude corresponding to this urging force between itself and at least one of the pressure-side member 25 and the suction-side member 27. By selecting the rigidity of the wave-shaped plate spring 44 serving as the urging member and adjusting the urging force when being disposed in the cavity (initial state), the properties of attenuating positional displacement between the pressure-side member 25 and the suction-side member 27 can be set to desired properties.

Furthermore, in the stationary blade 20 according to this embodiment, the wave-shaped plate spring 44 serving as a plate-like spring member having a plate shape extending in the blade-width direction and pressing the pressure-side member 25 and the suction-side member 27 with the elasticity due to distortion is provided. The urging member extending in the longitudinal direction of the plate-like member, i.e., the blade-width direction of the stationary blade, can be realized merely by curving a rectangular plate-like member in the width direction by pressing or the like.

Furthermore, in the stationary blade 20 according to this embodiment, the wave-shaped plate spring 44 has a wave-shaped cross section and is in contact with the pressure-side member 25 and the suction-side member 27 at the crests of the waves 46*a*, 46*c*, 46*e*, 48*a*, 48*c*, 48*e*, and 48*g*. The plate-like spring member formed into this wave shape can contact both the pressure-side member 25 and the suction-side member 27 at a plurality of crests in a slidable manner. Thus, the wave-shaped plate spring 44 can appropriately create friction between the pressure-side member 25 and/or the suction-side member 27.

Second Embodiment

Figure 7:
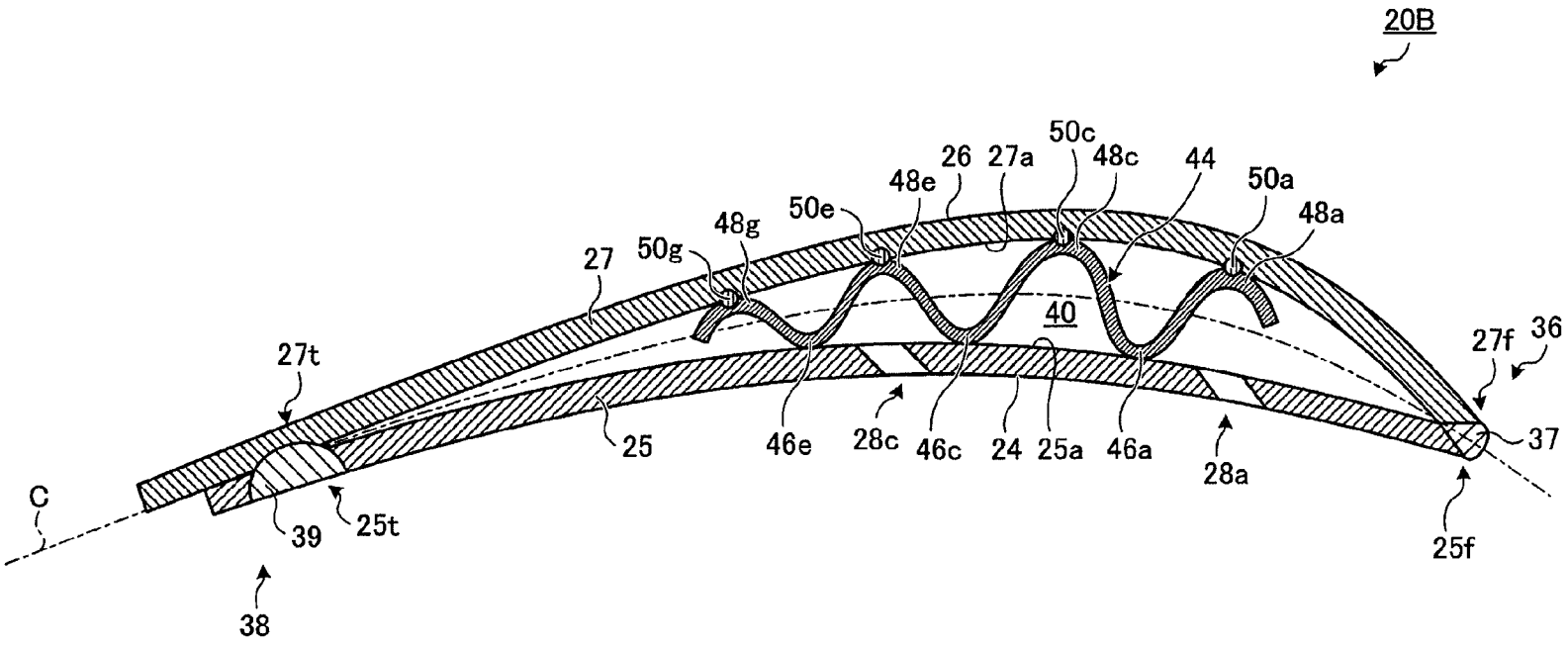
FIG. 7 is a view showing the blade shape of a stationary blade according to a second embodiment.

A stationary blade according to this embodiment will be described using FIG. 7. FIG. 7 is a diagram showing the blade shape of a stationary blade. The stationary blade according to this embodiment differs from that according to the first embodiment in that the plate-like spring member and the suction-side member are bonded. A fabrication process will be described in detail below. The configuration substantially in common with the stationary blade according to the first embodiment will be denoted by the same reference numerals, and a description thereof will be omitted.

A stationary blade 20B is produced as follows. First, the wave-shaped plate spring 44 is fixed to the suction-side member 27. More specifically, the back-side crests 48*a*, 48*c*, 48*e*, and 48*g* of the wave-shaped plate spring 44 are bonded to the rear face 27*a* of the suction-side member 27 by spot welding (the welded portions are denoted by reference numerals 50*a*, 50*c*, 50*e*, and 50*g*).

Although, in this embodiment, the suction-side member 27 and the wave-shaped plate spring 44 are fixed by spot welding, the method of bonding is not limited thereto. Bonding using the so-called "plug welding", in which the suction-side member 27 is bored and welding is performed so as to fill the bores, is also suitable.

Then, the suction-side member 27, to which the wave-shaped plate spring 44 is bonded, and the pressure-side member 25 are assembled and bonded by welding at the front edge 36 and the rear edge 38 of the stationary blade 20B. More specifically, a front edge 27*f* of the suction-side member 27 and a front edge 25*f* of the pressure-side member 25 are bonded by welding, and a rear edge 27*t* of the suction-side member 27 and a rear edge 25*t* of the pressure-side member 25 are bonded by welding.

In the thus-configured stationary blade 20B, the front-side crests 46*a*, 46*c*, and 46*e* of the wave-shaped plate spring 44 are in sliding contact with the rear face 25*a* of the pressure-side member 25. When the stationary blade 20B is elastically deformed, the wave-shaped plate spring 44 causes friction between the rear face 25*a* of the pressure-side member 25 and the front-side crests 46*a*, 46*c*, and 46*e*. This friction attenuates relative positional displacement between the pressure-side member 25 and the suction-side member 27. As a result, self-excited vibrations occurring at the stationary blade can be reduced.

As has been described above, in the stationary blade 20B according to this embodiment, the pressure-side member 25 and the suction-side member 27 are bonded to each other at the front edge 36 and the rear edge 38 of the stationary blade 20B, and the wave-shaped plate spring 44 serving as the plate-like spring member is bonded to the suction-side member 27. Thus, the stationary blade having the plate-like spring member between the pressure-side member 25 and the suction-side member 27 can be easily fabricated merely by bonding the plate-like member to the stationary blade 20 by welding. Moreover, because the wave-shaped plate spring 44 can be fixed to a desired position between the pressure-side member 25 and the suction-side member 27, the occurrence of variation in the properties of attenuating positional displacement between the pressure-side member 25 and the suction-side member 27 can be reduced.

Although, in the stationary blade 20B according to this embodiment, the wave-shaped plate spring 44 is bonded to the suction-side member 27, the counterpart member to which the wave-shaped plate spring 44 is bonded is not limited thereto. The wave-shaped plate spring 44 may be bonded to the pressure-side member 25.

Third Embodiment

Figure 8:
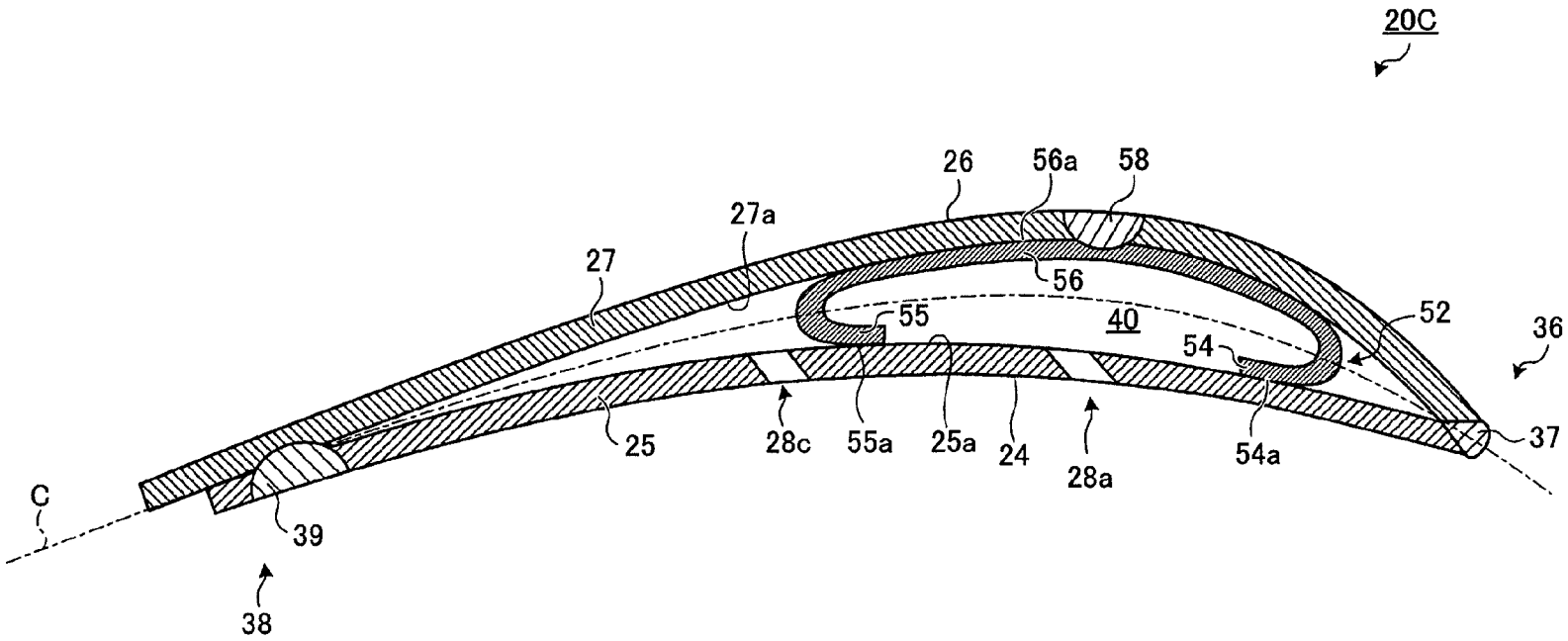
FIG. 8 is a view showing the blade shape of a stationary blade according to a third embodiment.
Figure 9:
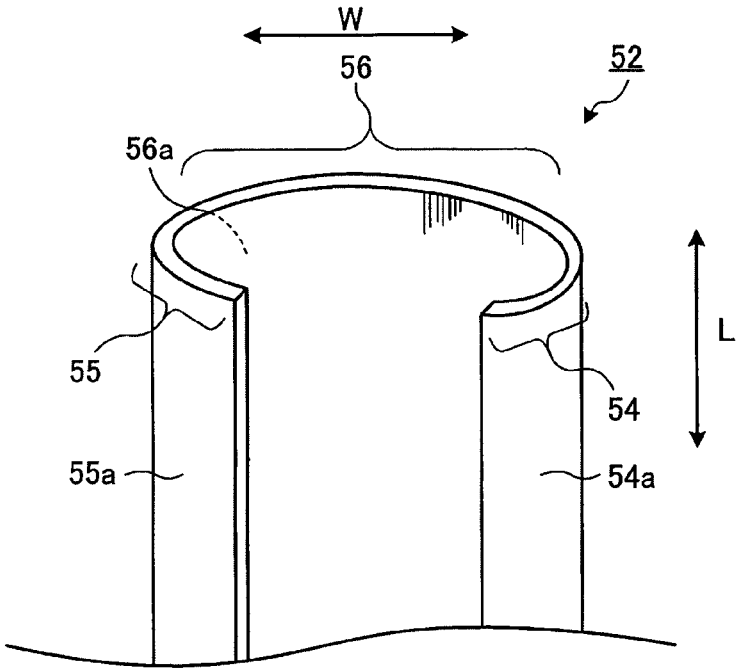
FIG. 9 is a perspective view of a plate-like spring member (C-shaped plate spring) according to the third embodiment.

A stationary blade according to this embodiment will be described using FIGS. 8 and 9. FIG. 8 is a view showing the blade shape of a stationary blade, and FIG. 9 is a perspective view of a plate-like spring member. The stationary blade according to this embodiment differs from that according to the first embodiment in that a "C-shaped plate spring" having a substantially C-shaped cross section, serving as the plate-like spring member, is provided. A detailed description will be given below. The configuration substantially in common with the stationary blade according to the first embodiment will be denoted by the same reference numerals, and a description thereof will be omitted.

As shown in FIG. 8, in a stationary blade 20C according to this embodiment, a C-shaped plate spring 52 having a substantially C-shaped cross section, serving as a plate-like spring member, is provided between the pressure-side member 25 and the suction-side member 27. The C-shaped plate spring 52 is in contact with the rear face 25*a* of the pressure-side member 25 at outer faces 54*a* and 55*a* of open-end portions 54 and 55. In addition, the C-shaped plate spring 52 is in contact with the rear face 27*a* of the suction-side member 27 at an outer face 56*a* of a base portion 56. That is, the C-shaped plate spring 52 is, when disposed in the cavity 40, in contact with the pressure-side member 25 at the open-end portions 54 and 55 and the suction-side member 27 at the base portion 56.

As shown in FIG. 9, the C-shaped plate spring 52 is formed by curving a metal plate-like member, extending in the longitudinal direction L, into a round shape in the width direction W. Note that the C-shaped plate spring 52 is formed such that the open-end portions 54 and 55 conform to the rear face 25*a* of the pressure-side member 25 and the base portion 56 conforms to the rear face 27*a* of the suction-side member 27. The C-shaped plate spring 52 is positioned such that the longitudinal direction L thereof agrees with the blade-width direction of the stationary blade, and, as shown in FIG. 8, the base portion 56 is fixed to the suction-side member 27 by welding (the welded portion is denoted by reference numeral 58). The C-shaped plate spring 52 is thus disposed in the cavity 40.

The C-shaped plate spring 52, when being disposed in the cavity 40 in this manner (initial state), is formed so as to be slightly elastically deformed by distortion. With this elasticity, the C-shaped plate spring 52 presses the pressure-side member 25 with the outer faces 54*a* and 55*a* of the open-end portions 54 and 55 from the rear face 25*a* and presses the suction-side member 27 with the outer face 56*a* of the base portion 56 from the rear face 27*a*. That is, the C-shaped plate spring 52 is configured to urge the pressure-side member 25 and the suction-side member 27 outward in the blade-thickness direction of the stationary blade 20C (i.e., the direction perpendicular to the one-dot chain line C in FIG. 8).

In the thus-configured stationary blade 20C, the outer faces 54*a* and 55*a* of the open-end portions 54 and 55 of the C-shaped plate spring 52 are in contact with the rear face 25*a* of the pressure-side member 25, and an urging force caused by distortion of the C-shaped plate spring 52 acts between the rear face 25*a* and the outer faces 54*a* and 55*a*.

When the stationary blade 20C is elastically deformed, the C-shaped plate spring 52 causes a kinetic frictional force, corresponding to the urging force, between the rear face 25*a* of the pressure-side member 25 and the outer faces 54*a* and 55*a* of the open-end portions 54 and 55. This kinetic frictional force attenuates relative positional displacement between the pressure-side member 25 and the suction-side member 27. As a result, self-excited vibrations occurring at the stationary blade can be reduced.

As has been described above, in the stationary blade 20C according to this embodiment, the C-shaped plate spring 52, which has a C-shaped cross section and is in contact with the pressure-side member 25 at the open-end portions 54 and 55 of the C shape and the suction-side member 27 at the base portion 56 of the C shape, is provided as the plate-like spring member. The plate-like spring member formed into this C shape can be in sliding contact with the pressure-side member 25 over a sufficient area and can appropriately create friction between itself and the pressure-side member when the stationary blade is elastically deformed.

Although, in the stationary blade 20C according to this embodiment, the C-shaped plate spring 52 is fixed to the suction-side member 27 at the base portion 56, the counterpart member to which the C-shaped plate spring 52 is fixed is not limited thereto. The C-shaped plate spring 52 may be fixed to the pressure-side member 25 at the open-end portions 54 and 55. In such a case, the base portion 56 of the C-shaped plate spring 52 can be in sliding contact with the suction-side member 27 over a sufficient area, appropriately creating friction between itself and the suction-side member 27 when the stationary blade is elastically deformed.

Fourth Embodiment

Figure 10:
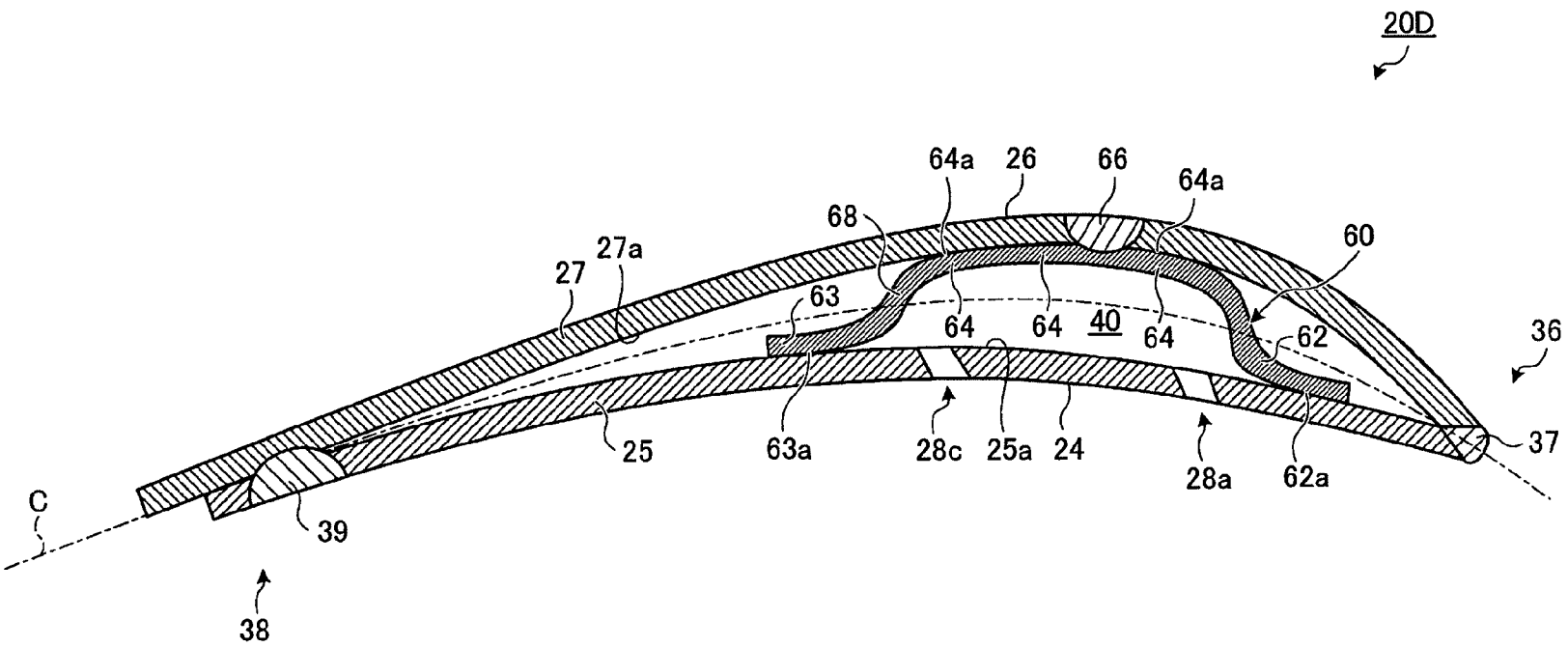
FIG. 10 is a view showing the blade shape of a stationary blade according to a fourth embodiment.
Figure 11:
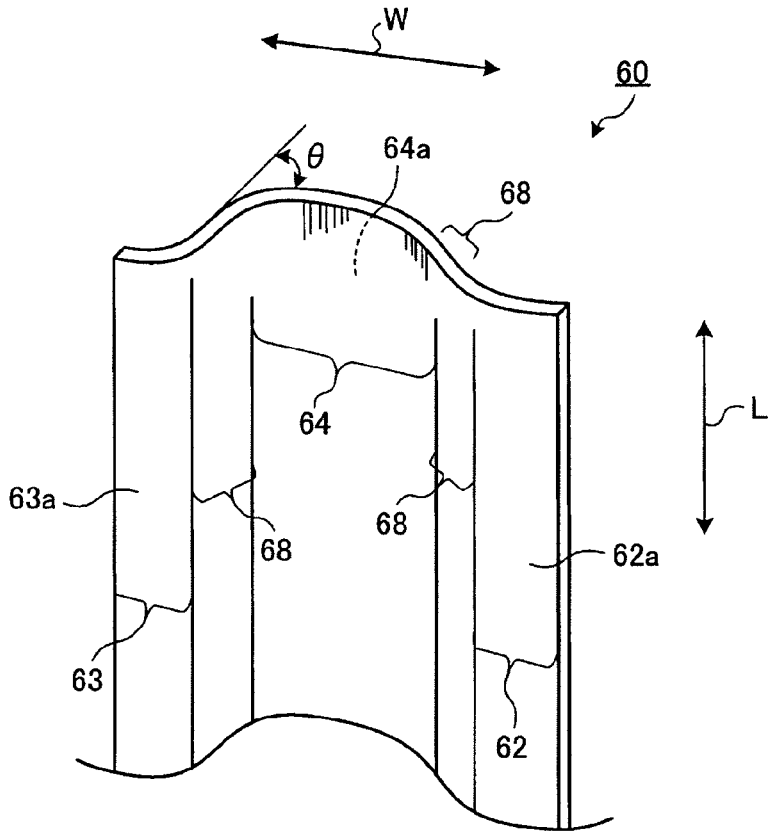
FIG. 11 is a perspective view of a plate-like spring member (bow-shaped plate spring) according to the fourth embodiment.

A stationary blade according to this embodiment will be described using FIGS. 10 and 11. FIG. 10 is a view showing the blade shape of a stationary blade, and FIG. 11 is a perspective view of a plate-like spring member. The stationary blade according to this embodiment differs from that according to the first embodiment in that a "bow-shaped plate spring" having a bow-shaped cross section, serving as the plate-like spring member, is provided. A detailed description will be given below. The configuration substantially in common with the stationary blade according to the first embodiment will be denoted by the same reference numerals, and a description thereof will be omitted.

As shown in FIG. 10, in a stationary blade 20D according to this embodiment, a bow-shaped plate spring 60 having a bow-shaped cross section, serving as the plate-like spring member, is provided between the pressure-side member 25 and the suction-side member 27. The bow-shaped plate spring 60 is in contact with the rear face 25*a* of the pressure-side member 25 at surfaces 62*a* and 63*a* of end portions 62 and 63. In addition, the bow-shaped plate spring 60 is in contact with the rear face 27*a* of the suction-side member 27 at a rear face 64*a* of a base portion 64. That is, the bow-shaped plate spring 60 is, when disposed in the cavity 40, in contact with the pressure-side member 25 at the end portions 62 and 63 of the bow-shaped plate spring 60 and the suction-side member 27 at the base portion 64.

As shown in FIG. 11, the bow-shaped plate spring 60 is formed by curving a metal plate-like member, extending in the longitudinal direction L, such that a smooth peak fold and valley fold are formed at two positions in the width direction W. Note that the bow-shaped plate spring 60 is formed such that the end portions 62 and 63 conform to the rear face 25*a* of the pressure-side member 25 and the base portion 64 conforms to the rear face 27*a* of the suction-side member 27. The bow-shaped plate spring 60 is positioned such that the longitudinal direction L thereof agrees with the blade-width direction of the stationary blade 20D and is fixed to the suction-side member 27 at the base portion 64 by welding (the welded portion is denoted by reference numeral 66). The bow-shaped plate spring 60 is thus disposed in the cavity 40.

The bow-shaped plate spring 60, when being disposed in the cavity 40 in this manner (initial state), is formed so as to be slightly elastically deformed by distortion. With this elasticity, the bow-shaped plate spring 60 presses the pressure-side member 25 with the surfaces 62*a* and 63*a* of the end portions 62 and 63 from the rear face 25*a* and presses the suction-side member 27 with the rear face 64*a* of the base portion 64 from the rear face 27*a*. That is, the bow-shaped plate spring 60 is configured to urge the pressure-side member 25 and the suction-side member 27 outward in the blade-thickness direction of the stationary blade 20D (i.e., the direction perpendicular to the one-dot chain line C in FIG. 10).

In the thus-configured stationary blade 20D, the surfaces 62*a* and 63*a* of the end portions 62 and 63 of the bow-shaped plate spring 60 are in sliding contact with the rear face 25*a* of the pressure-side member 25, and an urging force caused by distortion of the bow-shaped plate spring 60 acts between the rear face 25*a* and the surfaces 62*a* and 63*a*.

When the stationary blade 20D is elastically deformed, the bow-shaped plate spring 60 causes a kinetic frictional force, corresponding to the urging force, between the rear face 25*a* of the pressure-side member 25 and the surfaces 62*a* and 63*a* of the end portions 62 and 63. This kinetic frictional force attenuates relative positional displacement between the pressure-side member 25 and the suction-side member 27. As a result, self-excited vibrations occurring at the stationary blade can be reduced.

As shown in FIG. 11, in this embodiment, by changing a bending angle θ formed between the base portion 64 and a connecting portion 68, the urging force of the bow-shaped plate spring 60 acting on the pressure-side member 25 and the suction-side member 27, i.e., the kinetic frictional force produced when the stationary blades 20D are elastically deformed, can be easily adjusted.

As has been described above, in the stationary blade 20D according to this embodiment, the bow-shaped plate spring 60, which has a bow-shaped cross section and is in contact with the pressure-side member 25 at the end portions 62 and 63 of the bow shape and the suction-side member 27 at the base portion 64 of the bow shape, is provided as the plate-like spring member. The plate-like spring member formed in this bow shape can be in sliding contact with the pressure-side member over a sufficient area and can appropriately create friction between itself and the pressure-side member when the stationary blade is elastically deformed. The plate-like spring member can be realized merely by forming a smooth peak fold and valley fold at two positions on a flat plate-like member.

Although, in the stationary blade 20D according to this embodiment, the bow-shaped plate spring 60 is fixed to the suction-side member 27 at the base portion 64, the counterpart member to which the bow-shaped plate spring 60 is fixed is not limited thereto. The bow-shaped plate spring 60 may be fixed to the pressure-side member 25 at the end portions 62 and 63 thereof. In such a case, the base portion of the bow-shaped plate spring can be in sliding contact with the suction-side member over a sufficient area and can appropriately create friction between itself and the suction-side member when the stationary blade is elastically deformed.

Fifth Embodiment

Figure 12:
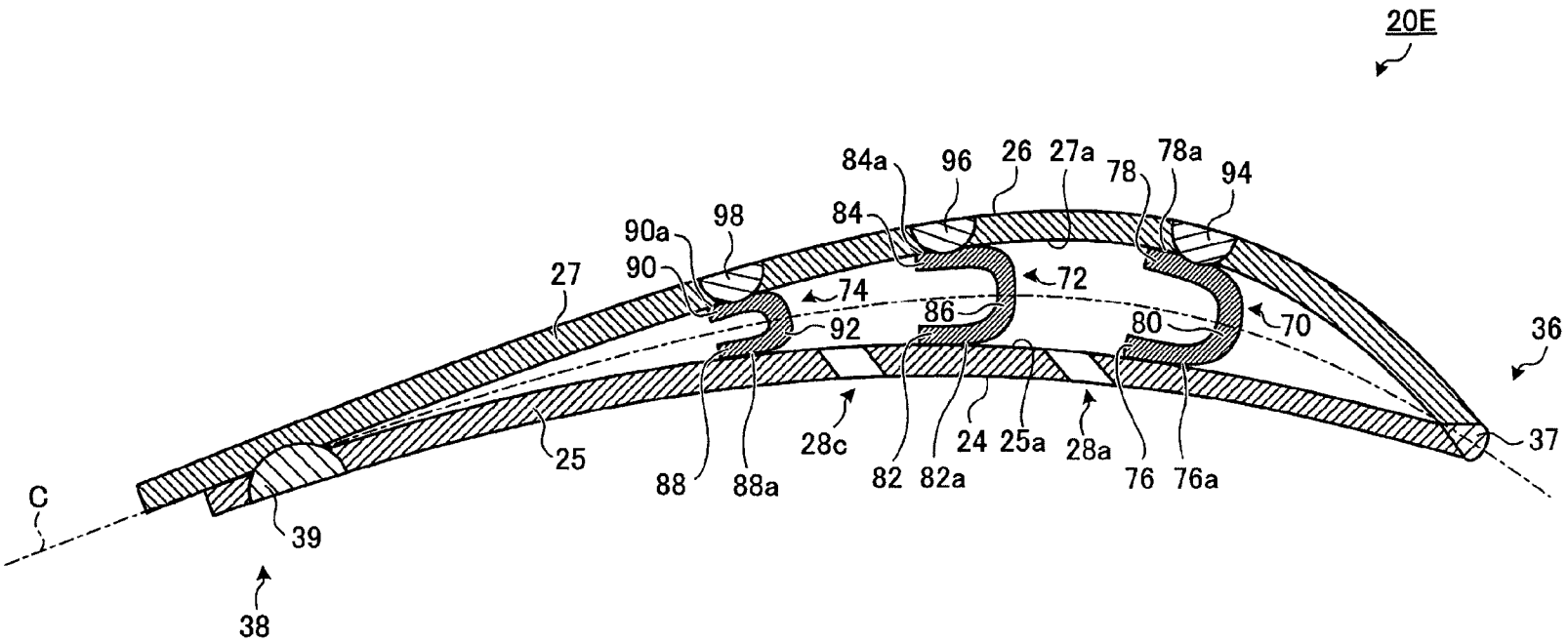
FIG. 12 is a view showing the blade shape of a stationary blade according to a fifth embodiment.
Figure 13:
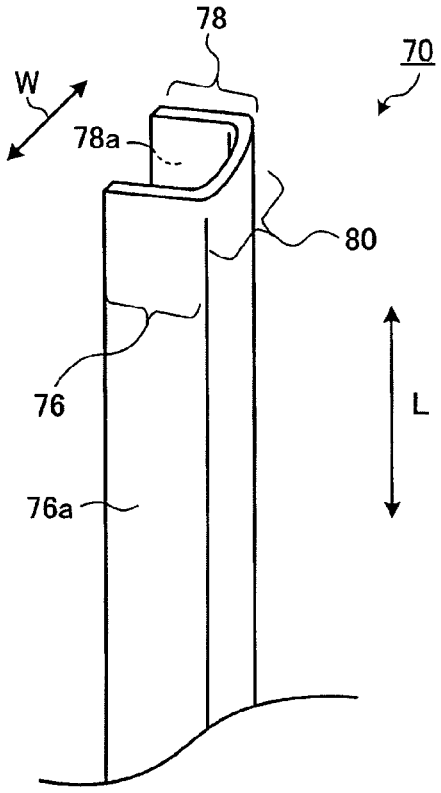
FIG. 13 is a perspective view of a plate-like spring member (angular U-shaped plate spring) according to the fifth embodiment.

A stationary blade according to this embodiment will be described using FIGS. 12 and 13. FIG. 12 is a view showing the blade shape of a stationary blade, and FIG. 13 is a perspective view of a plate-like spring member. The stationary blade according to this embodiment differs from that according to the first embodiment in that a plurality of "angular U-shaped plate springs" having an angular U-shaped cross section, serving as the plate-like spring members, are provided. A detailed description will be given below. The configuration substantially in common with the stationary blade according to the first embodiment will be denoted by the same reference numerals, and a description thereof will be omitted.

As shown in FIG. 12, in a stationary blade 20E according to this embodiment, angular U-shaped plate springs 70, 72, and 74 having a substantially angular U-shaped cross section, serving as the plate-like spring members, are provided between the pressure-side member 25 and the suction-side member 27. The angular U-shaped plate spring 70 is disposed on the front edge 36 side of the front-edge-side slits 28*a*, the angular U-shaped plate spring 72 is disposed between the front-edge-side slits 28*a* and the rear-edge-side slits 28*c*, and the angular U-shaped plate spring 74 is disposed on the rear edge 38 side of the rear-edge-side slits 28*c*.

These angular U-shaped plate springs 70, 72, and 74 are in contact with the rear face 25*a* of the pressure-side member 25 at outer faces 76*a*, 82*a*, and 88*a* of their first arm portions 76, 82, and 88, respectively. In addition, the angular U-shaped plate springs 70, 72, and 74 are in contact with the rear face 27*a* of the suction-side member 27 at outer faces 78*a*, 84*a*, and 90*a* of their second arm portions 78, 84, and 90, respectively.

As shown in FIG. 13, the angular U-shaped plate spring 70 is formed by curving a metal plate-like member, extending in the longitudinal direction L, such that it is bent at two positions, in the width direction W, in the same direction at about 90 degrees. Note that the angular U-shaped plate spring 70 is formed such that the first arm portion 76 conforms to the rear face 25*a* of the pressure-side member 25 and the second arm portion 78 conforms to the rear face 27*a* of the suction-side member 27. The angular U-shaped plate springs 72 and 74 have a configuration substantially in common with the angular U-shaped plate spring 70. The angular U-shaped plate springs 70, 72, and 74 are positioned such that the longitudinal direction L thereof agrees with the blade-width direction of the stationary blade 20E and are fixed to the suction-side member 27 at the second arm portions 78, 84, and 90 by welding (the welded portions are denoted by reference numerals 94, 96, and 98, respectively). The angular U-shaped plate springs 70, 72, and 74 are thus disposed in the cavity 40.

The angular U-shaped plate springs 70, 72, and 74, when being disposed in the cavity 40 in this manner (initial state), are formed such that they are slightly elastically deformed by distortion. With this elasticity, the angular U-shaped plate springs 70, 72, and 74 press the pressure-side member 25 with the outer faces 76*a*, 82*a*, and 88*a* of the first arm portions 76, 82, and 88 from the rear face 25*a* and press the suction-side member 27 with the outer faces 78*a*, 84*a*, and 90*a* of the second arm portions 78, 84, and 90 from the rear face 27*a*. That is, the angular U-shaped plate springs 70, 72, and 74 are configured to urge the pressure-side member 25 and the suction-side member 27 outward in the blade-thickness direction of the stationary blade 20E (i.e., the direction perpendicular to the one-dot chain line C in FIG. 12).

In the thus-configured stationary blade 20E, the outer faces 76*a*, 82*a*, and 88*a* of the first arm portions 76, 82, and 88 of the angular U-shaped plate springs 70, 72, and 74 are in sliding contact with the rear face 25*a* of the pressure-side member 25, and an urging force caused by distortion of the angular U-shaped plate springs 70, 72, and 74 acts between the rear face 25*a* and the outer faces 76*a*, 82*a*, and 88*a*. When the stationary blade 20E is elastically deformed, the angular U-shaped plate springs 70, 72, and 74 cause a kinetic frictional force, corresponding to the urging force, between the rear face 25*a* of the pressure-side member 25 and the outer faces 76*a*, 82*a*, and 88*a* of the first arm portions 76, 82, and 88. This kinetic frictional force attenuates relative positional displacement between the pressure-side member 25 and the suction-side member 27. As a result, self-excited vibrations occurring at the stationary blade can be reduced.

As has been described above, in the stationary blade 20E according to this embodiment, the angular U-shaped plate springs 70, 72, and 74, which have a substantially angular U-shaped cross section and are in contact with the pressure-side member 25 at the first arm portions 76, 82, and 88 of the angular U shape and the suction-side member 27 at the second arm portions 78, 84, and 90, are provided as the plate-like spring members. The plate-like spring members formed in this angular U shape can simplify the fabrication of the plate-like spring members. Furthermore, because the plate-like spring members are compact, they are easily disposed in the cavity.

Sixth Embodiment

Figure 14:
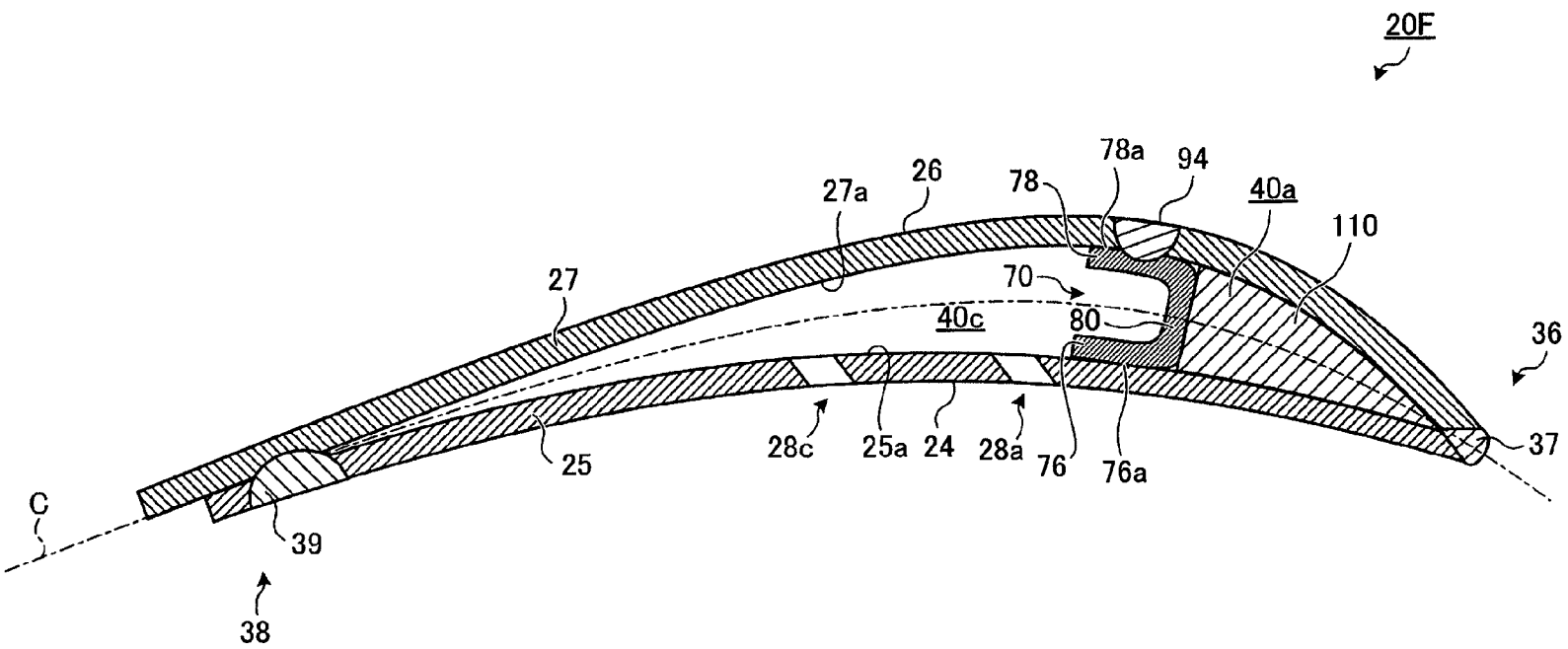
FIG. 14 is a view showing the blade shape of a stationary blade according to a sixth embodiment.

A stationary blade according to this embodiment will be described using FIG. 14. FIG. 14 is a view showing the blade shape of a stationary blade. The stationary blade according to this embodiment differs from that according to the fifth embodiment in that a cavity not communicating with the outside via a slit is filled with a damping material. A detailed description will be given below. The configuration substantially in common with the stationary blade according to the first embodiment will be denoted by the same reference numerals, and a description thereof will be omitted.

As shown in FIG. 14, in a stationary blade 20F according to this embodiment, the angular U-shaped plate spring 70, serving as the plate-like spring member, is disposed between the pressure-side member 25 and the suction-side member 27. The angular U-shaped plate spring 70 is disposed on the front edge 36 side of the front-edge-side slits 28*a*. The angular U-shaped plate spring 70 is in contact with the rear face 25*a* of the pressure-side member 25 at an outer face 76*a* of the first arm portion 76 and is fixed to the suction-side member 27 at the second arm portion 78 by welding.

By disposing the angular U-shaped plate spring 70 in this manner, the space between the pressure-side member 25 and the suction-side member 27 is divided into a cavity 40*a* on the front edge 36 side of the base portion 80 of the angular U-shaped plate spring 70 and a cavity 40*c* on the rear edge 38 side of the base portion 80 of the angular U-shaped plate spring 70.

The cavity 40*c* on the rear edge 38 side communicates with the outside of the stationary blade 20F via the slits 28*a* and 28*c*. The water deposited on the pressure-side face 24 of the stationary blade 20F flows into the cavity 40*c* through the slits 28*a* and 28*c*. The water taken into the cavity 40*c* flows in the blade-width direction toward the shroud (see FIG. 3).

On the other hand, the cavity 40*a* on the front edge 36 side does not communicate with the outside of the stationary blade 20F via the slits (28*a* and 28*c*). That is, this cavity 40*a* does not have a function to take the water therein from the pressure-side face and flow the water toward the shroud.

In the stationary blade 20F according to this embodiment, the cavity 40*a* is provided with a damping material 110. Examples of the damping material include a rubber or plastic material.

In the thus-configured stationary blade 20F, the outer face 76*a* of the first arm portion 76 of the angular U-shaped plate spring 70 is in contact with the rear face 25*a* of the pressure-side member 25, and an urging force of the angular U-shaped plate spring 70 acts between the outer face 76*a* and the rear face 25*a*.

When the stationary blade 20F is elastically deformed, the angular U-shaped plate spring 70 causes a kinetic frictional force corresponding to the urging force between the outer face 76*a* of the first arm portion 76 and the rear face 25*a* of the pressure-side member 25, the damping material 110 disposed in the cavity 40*a* is deformed, and deformation resistance of the damping material 110 acts on the pressure-side member 25 and the suction-side member 27. This attenuates relative positional displacement between the pressure-side member 25 and the suction-side member 27. As a result, self-excited vibrations occurring at the stationary blade can be reduced.

As has been described above, in the stationary blade 20F according to this embodiment, among the cavities (40*a* and 40*c*) divided by the angular U-shaped plate spring 70, the cavity 40*a* not communicating with the outside via the slits (28*a* and 28*c*) is provided with the damping material 110. Using the deformation resistance of the damping material 110, the relative positional displacement between the pressure-side member 25 and the suction-side member 27 can be attenuated.

Seventh Embodiment

Figure 15:
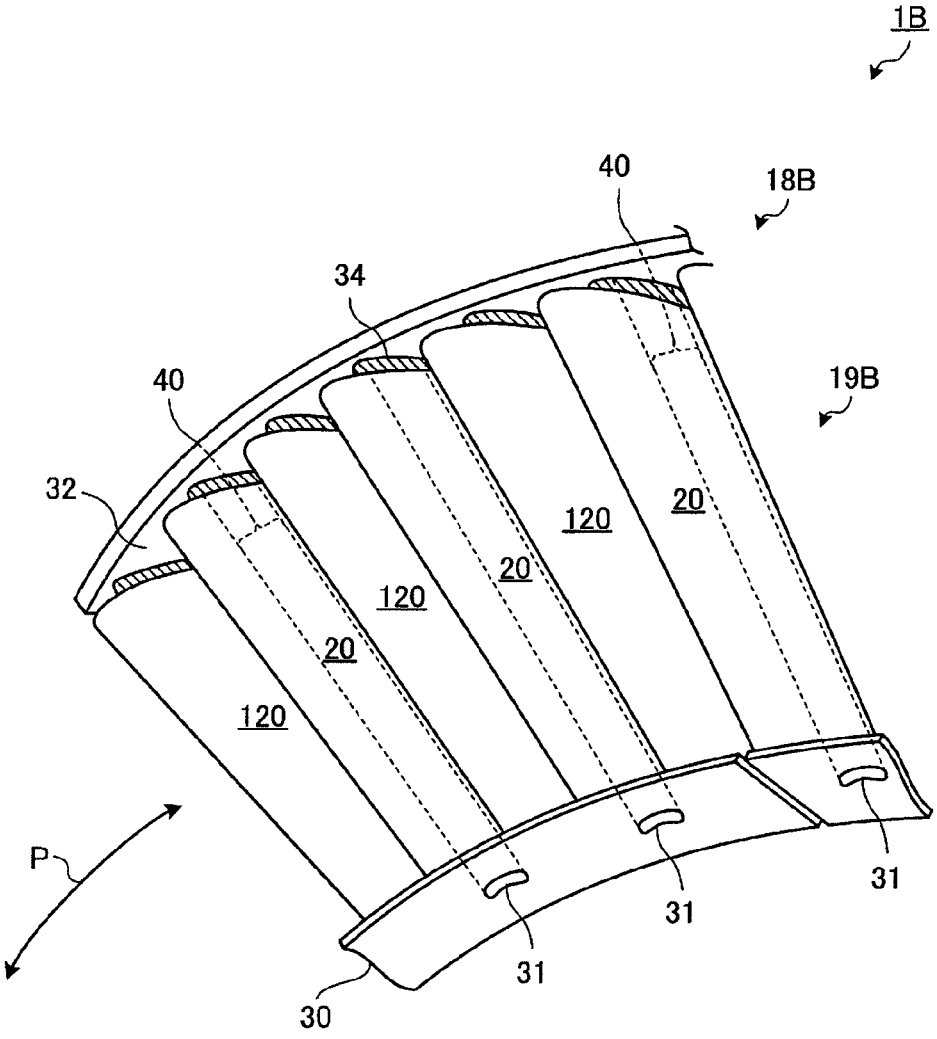
FIG. 15 is a perspective view showing an arrangement of stationary blades in a blade group in a low-pressure final stage of a steam turbine according to a seventh embodiment.

A steam turbine according to this embodiment will be described using FIG. 15. FIG. 15 is a perspective view showing an arrangement of stationary blades in a low-pressure final stage of a steam turbine. The steam turbine according to this embodiment differs from the steam turbine 1 according to the first embodiment in that the stationary blades according to the above-described embodiments (hereinafter referred to as "hollow stationary blades") and solid stationary blades having no cavities therein are arranged in a mixed manner in the same stage, and a detailed description will be given below. The configuration substantially in common with the stationary blade according to the first embodiment will be denoted by the same reference numerals, and a description thereof will be omitted.

As shown in FIG. 15, in a steam turbine 1B according to this embodiment, in a blade group 19B in the low-pressure final stage 18B thereof, the hollow stationary blades 20 according to the first embodiment and solid stationary blades 120 having no cavities therein are alternately arranged in the circumferential direction P of the rotor shaft. Stationary blades having substantially the same exterior shape (geometrical shape) as the hollow stationary blades 20 are used as the solid stationary blades 120. The hollow stationary blades 20 and the solid stationary blades 120 are fixed to the blade root ring 32 at one end and are fixed to the inner shroud 30 at the other end.

The inner shroud 30 has openings 31 communicating with the cavities 40 at positions corresponding to the cavities 40 of the hollow stationary blades 20. The water taken into the cavities 40 of the hollow stationary blades 20 through the slits (see FIG. 4) is discharged from these openings 31.

As has been described above, in the steam turbine 1B according to this embodiment, the hollow stationary blades 20 having the cavities 40 therein and the solid stationary blades 120 having no cavities therein are arranged in a mixed manner in the blade group 19B in the same stage 18B. Therefore, it is possible to arrange the hollow stationary blades and the solid stationary blades having a great difference in natural frequency next to each other without varying the exterior shape of the stationary blades. Thus, self-excited vibrations occurring due to stationary blades having substantially the same natural frequencies being arranged next to each other in the blade group in the same stage can be reduced.

Furthermore, in the steam turbine 1B according to this embodiment, the hollow stationary blades 20 are arranged at predetermined intervals in the circumferential direction P of the rotor shaft in the blade group 19B in the same stage 18B. Therefore, it is highly possible that the solid stationary blade 120 having the same exterior shape as the hollow stationary blade 20 but a different natural frequency is disposed next to the hollow stationary blade 20. Because the solid stationary blades that are less likely to cause self-excited vibrations (flutter) can be disposed next to the hollow stationary blades that tend to cause self-excited vibrations (flutter) due to their low weight, the above-described self-excited vibrations can be reduced.

Moreover, in the steam turbine 1B according to this embodiment, the hollow stationary blades 20 and the solid stationary blades 120 are alternately arranged in the blade group 19B in the same stage 18B. It can be ensured that the stationary blades next to each other in the blade group in the same stage have different natural frequencies.

Although, in the steam turbine 1B according to this embodiment, the hollow stationary blades 20 and the solid stationary blades 120 are alternately arranged, the arrangement of the hollow stationary blades is not limited thereto. As long as the hollow stationary blades and the solid stationary blades having different natural frequencies are arranged next to each other as much as possible, for example, one solid stationary blade may be disposed every two hollow stationary blades. Thus, one solid stationary blade can always be disposed next to the hollow stationary blade. While arranging as many as possible the hollow stationary blades capable of taking the moisture deposited on the blade surface into the cavities and removing it in the same stage, self-excited vibrations occurring at the stationary blades can be minimized.

Eighth Embodiment

Figure 16:
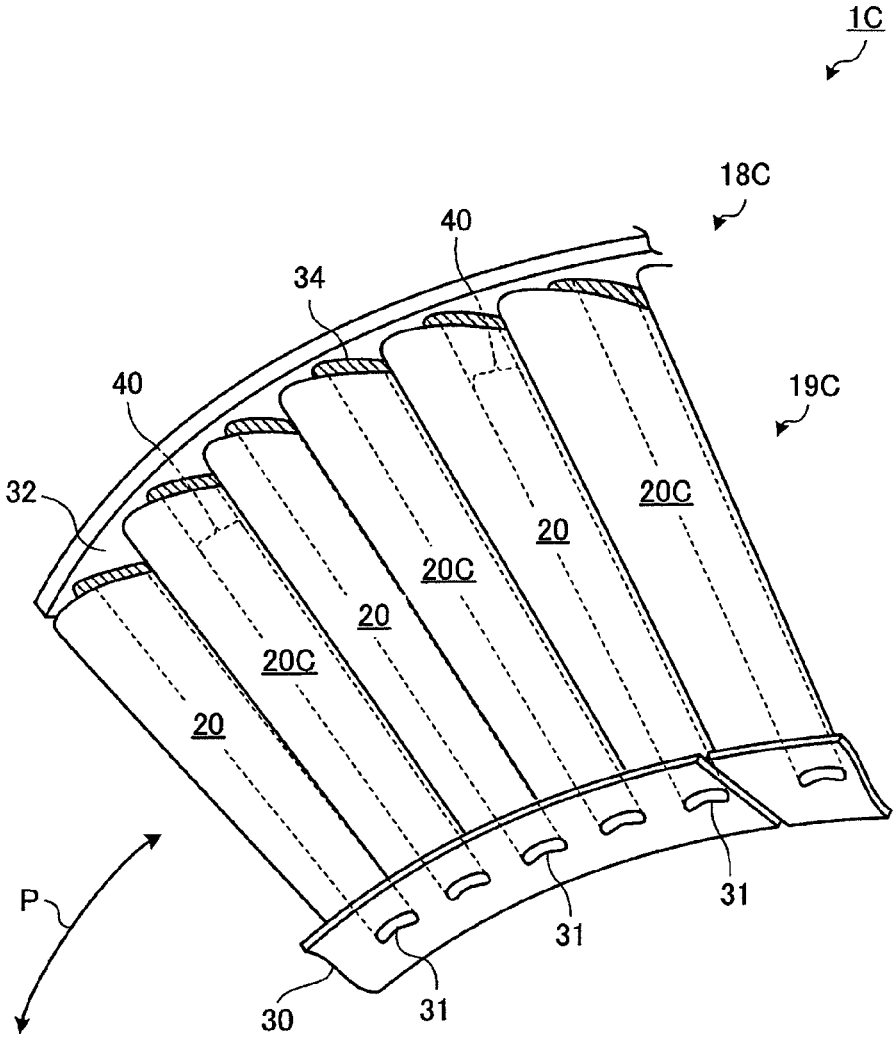
FIG. 16 is a perspective view showing an arrangement of stationary blades in a blade group in a low-pressure final stage of a steam turbine according to an eighth embodiment.

A steam turbine according to this embodiment will be described using FIG. 16. FIG. 16 is a perspective view showing an arrangement of stationary blades in a low-pressure final stage of a steam turbine. The steam turbine according to this embodiment differs from the steam turbine 1 according to the first embodiment in that, among the hollow stationary blades according to the first to sixth embodiments, first stationary blades and second stationary blades having different natural frequencies are arranged in a mixed manner in the same stage, and a detailed description will be given below. The configuration substantially in common with the stationary blade according to the first embodiment will be denoted by the same reference numerals, and a description thereof will be omitted.

As shown in FIG. 16, in a steam turbine 1C according to this embodiment, in a blade group 19C in the low-pressure final stage 18C thereof, the hollow stationary blades 20 according to the first embodiment (hereinafter referred to as "first stationary blades") and the hollow stationary blades 20C according to the third embodiment (hereinafter referred to as "second stationary blades") are alternately arranged in the circumferential direction P of the rotor shaft 14. As described above, because the first stationary blades 20 and the second stationary blades 20C have the plate-like spring members, which are provided in the cavities 40, having different shapes, their natural frequencies are also different. Note that the first stationary blades 20 and the second stationary blades 20C have the same pressure-side member 25 and suction-side member 27, whereby they have substantially the same exterior shapes (geometrical shapes).

The first stationary blades 20 and the second stationary blades 20C are fixed to the blade root ring 32 at one end and are fixed to the inner shroud 30 at the other end. The inner shroud 30 has openings 31 communicating with the cavities 40, at positions corresponding to the cavities 40 of the first stationary blades 20 and the second stationary blades 20C. The water taken into the cavities 40 of the first stationary blades 20 and the second stationary blades 20C through the slits (see FIG. 4) is discharged from these openings 31.

As has been described above, in the steam turbine 1C according to this embodiment, the first stationary blades 20 and the second stationary blades 20C having different natural frequencies are arranged in a mixed manner in the blade group 19C in the same stage 18C. Therefore, it is possible to arrange the hollow stationary blades having different natural frequencies next to each other without varying the exterior shape of the stationary blades. Thus, while using only the hollow stationary blades capable of taking the moisture deposited on the blade surfaces into the cavities and removing it, self-excited vibrations occurring due to stationary blades having substantially the same natural frequencies being arranged next to each other in the same stage can be reduced.

Furthermore, in the steam turbine 1C according to this embodiment, the first stationary blades 20 are arranged at predetermined intervals in the circumferential direction P of the rotor shaft. Therefore, the second stationary blades 20C having different natural frequency are assuredly disposed next to the first stationary blades 20. Even if only hollow stationary blades are used in the blade group in the same stage, self-excited vibrations occurring due to stationary blades having substantially the same natural frequencies being arranged next to each other can be more assuredly reduced.

Furthermore, in the steam turbine 1C according to this embodiment, the first hollow stationary blades 20 and the second hollow stationary blades 20C are alternately arranged. It can be ensured that the hollow stationary blades next to each other in the blade group in the same stage have different natural frequencies.

Although, in the steam turbine 1C according to this embodiment, the first hollow stationary blades 20 and the second hollow stationary blades 20C are alternately arranged, the arrangement of the hollow stationary blades is not limited thereto. It is preferable that two types of hollow stationary blades having natural frequencies that differ to the greatest extent be selected from the hollow stationary blades according to the first to sixth embodiments and be alternately arranged in the blade group in the same stage.

Ninth Embodiment

Figure 17:
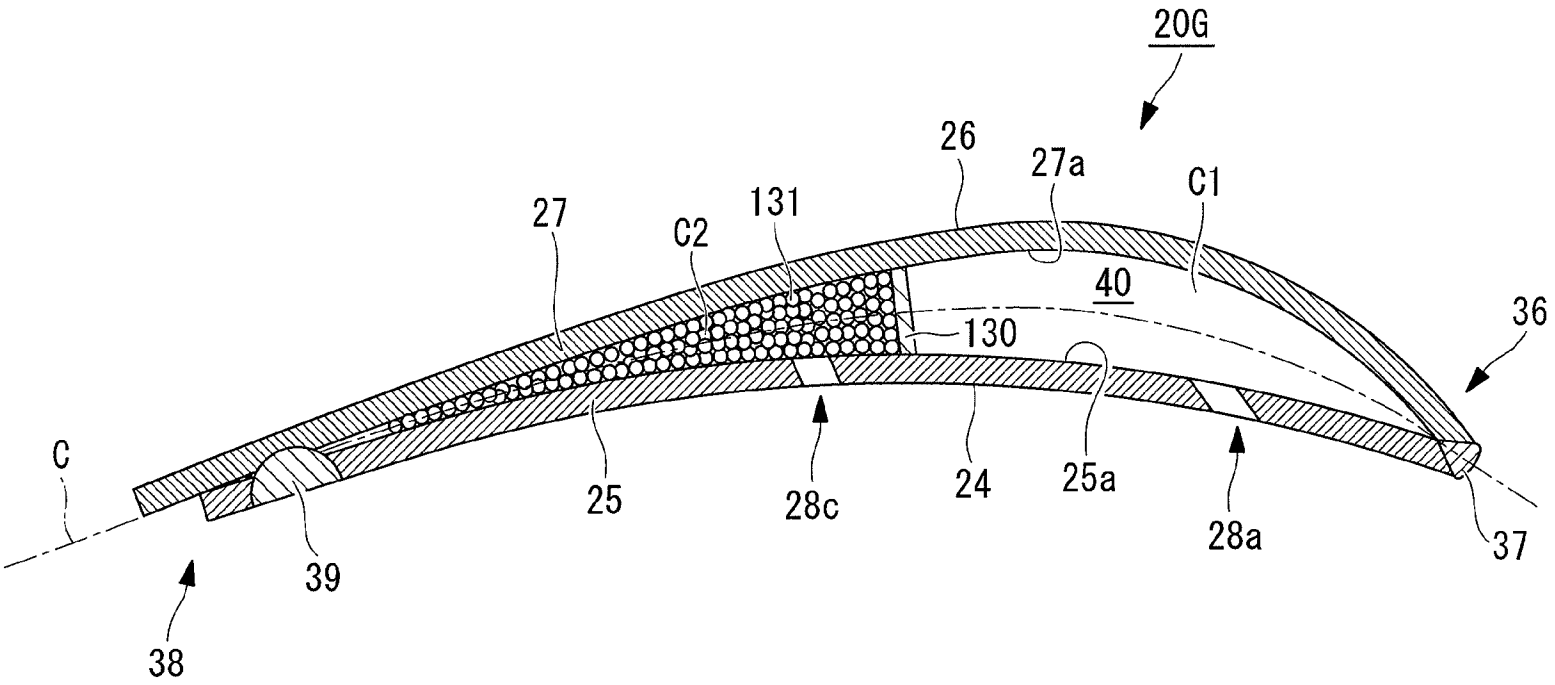
FIG. 17 is a view showing the blade shape of a stationary blade according to a ninth embodiment.

A stationary blade according to this embodiment will be described using FIG. 17. FIG. 17 is a view showing the blade shape of a stationary blade. A stationary blade 20G according to this embodiment differs from those according to the above-described embodiments in that a plate-like rib (dividing wall: partition wall) 130 is provided substantially perpendicular to the mean camber line of the blade (the center line connecting the front edge and the rear edge) C and divides the cavity (the inside of the stationary blade 20G) 40 into a front-edge-side cavity (cavity) C1 and a rear-edge-side cavity (cavity) C2 and in that the rear-edge-side cavity C2 is filled with a damping material 131. A detailed description will be given below. The configuration substantially in common with the stationary blade according to the above-described embodiments will be denoted by the same reference numerals, and a description thereof will be omitted.

Examples of the damping material 131 according to this embodiment include, for example, steel balls, as shown in FIG. 17. It is also possible to fill the rear-edge-side cavity C2 with the damping material 110 formed of a rubber or plastic material, as described in the sixth embodiment.

In the stationary blade 20G according to this embodiment, when the stationary blade 20G is elastically deformed, the steel balls 131 filling the cavity C2 collide with (are rubbed against) one another, producing frictional attenuation (or, the damping material 131 formed of a rubber or plastic material disposed in the cavity C2 are deformed, allowing deformation resistance of the damping material 131 to act on the pressure-side member 25 and the suction-side member 27). This attenuates relative positional displacement between the pressure-side member 25 and the suction-side member 27. As a result, self-excited vibrations occurring at the stationary blades can be reduced.

As has been described above, in the stationary blade 20G according to this embodiment, the damping material 131 is provided in the cavity C2 partitioned by the rib 130. Using deformation resistance of the damping material 131, relative positional displacement between the pressure-side member 25 and the suction-side member 27 can be attenuated.

Furthermore, in the stationary blade 20G according to this embodiment, because the rear-edge-side cavity C2 is filled with the damping material 131 instead of the plate spring, uneven contact of the plate spring caused by the dimensional tolerance of the plate spring and the dimensional tolerance of the blade (the pressure-side member 25 and the suction-side member 27) can be prevented.

Because other functions and advantages are the same as those of the above-described embodiments, descriptions thereof will be omitted here.

Tenth Embodiment

Figure 18:
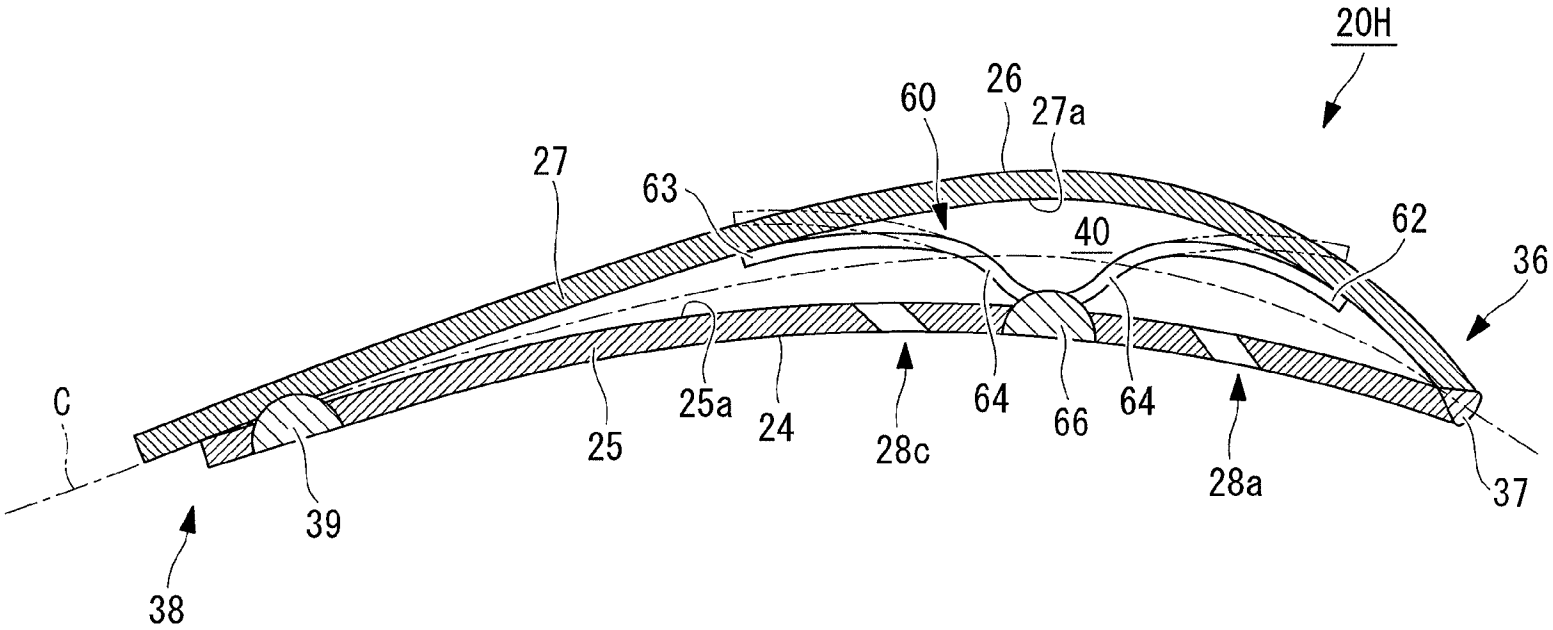
FIG. 18 is a view showing the blade shape of a stationary blade according to a tenth embodiment.

A stationary blade according to this embodiment will be described using FIG. 18. FIG. 18 is a view showing the blade shape of a stationary blade. A stationary blade 20H according to this embodiment differs from the stationary blade 20D according to the fourth embodiment in that the end portions 62 and 63 of the bow-shaped plate spring 60 are disposed so as to conform to the rear face 27*a* of the suction-side member 27 and the base portion 64 is disposed so as to conform to the rear face 25*a* of the pressure-side member 25. A detailed description will be given below. The configuration substantially in common with the stationary blade 20D according to the fourth embodiment will be denoted by the same reference numerals, and a description thereof will be omitted.

In the stationary blade 20H according to this embodiment, because, when the bow-shaped plate spring 60 is incorporated into the cavity 40, the end portions 62 and 63 of the bow-shaped plate spring 60 are formed such that they are securely pressed against the rear face 27*a* of the suction-side member 27 having a larger curvature than the rear face 25*a* of the pressure-side member 25, the end portions 62 and 63 of the bow-shaped plate spring 60 can be assuredly brought into contact with (touch) the rear face 27*a* of the suction-side member 27, and uneven contact of the plate spring caused by the dimensional tolerance of the plate spring and the dimensional tolerance of the blade (the pressure-side member 25 and the suction-side member 27) can be prevented.

Because other functions and advantages are the same as those of the fourth embodiment, descriptions thereof will be omitted here.

Note that a two-dot chain line in FIG. 18 indicates the sectional shape of the bow-shaped plate spring 60 before being incorporated into the cavity 40.

Eleventh Embodiment

Figure 19A:
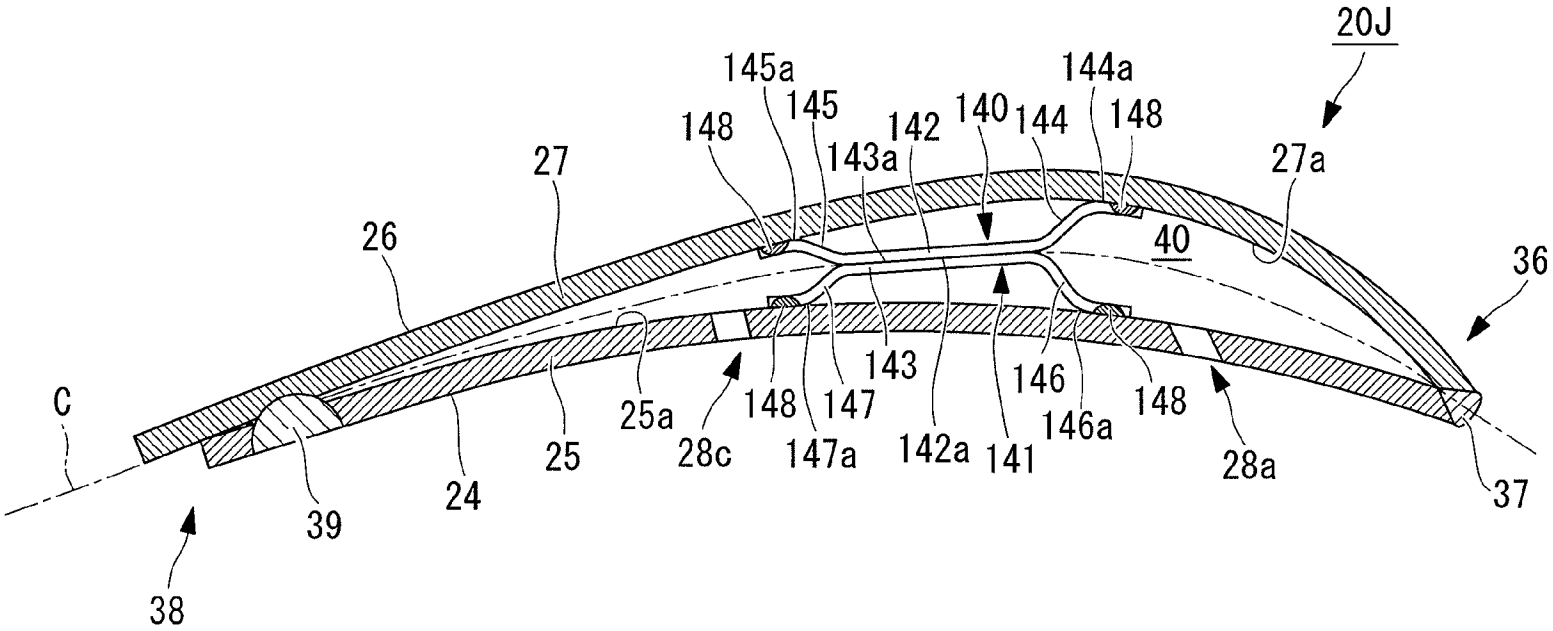
FIG. 19A is a view showing the blade shape of a stationary blade according to an eleventh embodiment.

A stationary blade according to this embodiment will be described using FIGS. 19A and 19B. FIG. 19A is a view showing the blade shape of a stationary blade. A stationary blade 20J according to this embodiment differs from the stationary blade 20 according to the first embodiment in that two "bow-shaped plate springs" having a bow-shaped cross section are provided as the plate-like spring member. A detailed description will be given below. The configuration substantially in common with the stationary blade according to the first embodiment will be denoted by the same reference numerals, and a description thereof will be omitted.

Figure 19B:
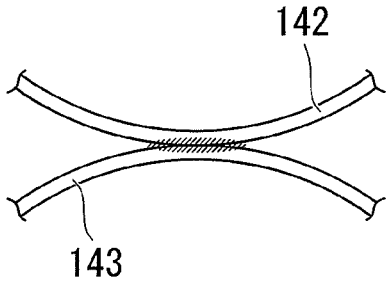
FIG. 19B is a view showing the stationary blade according to the eleventh embodiment, showing a sectional shape of a bow-shaped plate spring before being incorporated into the cavity.

As shown in FIGS. 19A and 19B, in the stationary blade 20J according to this embodiment, rear faces 142*a* and 143*a* of base portions 142 and 143 of bow-shaped plate springs 140 and 141, which have a bow-shaped cross section and serve as the plate-like spring member, are in sliding contact with (touch) each other, and, as shown in FIG. 19A, surfaces 144*a* and 145*a* of end portions 144 and 145 are in contact with the rear face 27*a* of the suction-side member 27 and surfaces 146*a* and 147*a* of end portions 146 and 147 are in contact with the rear face 25*a* of the pressure-side member 25. The end portions 144, 145, 146, and 147 are fixed by welding (the welded portions are denoted by reference numeral 148).

In the stationary blade 20J according to this embodiment, because the end portions 144 and 145 of the bow-shaped plate spring 140 are fixed to the suction-side member 27 by welding and the end portions 146 and 147 of the bow-shaped plate spring 141 are fixed to the pressure-side member 25 by welding, uneven contact between the suction-side member 27 and the end portions 144 and 145, as well as uneven contact between the pressure-side member 25 and the end portions 146 and 147, caused by the dimensional tolerance of the plate spring and the dimensional tolerance of the blade (the pressure-side member 25 and the suction-side member 27) can be assuredly prevented.

Furthermore, uneven contact between the rear face 142*a* of the base portion 142 and the rear face 143*a* of the base portion 143 can be prevented by appropriately selecting the material of the bow-shaped plate springs 140 and 141 (by selecting such a material that the rear faces 142*a* and 143*a* are not unevenly in contact with each other).

Because other functions and advantages are the same as those of the first embodiment, descriptions thereof will be omitted here.

Note that FIG. 19B shows the sectional shape of the bow-shaped plate springs 140 and 141 before being incorporated into the cavity 40.

Twelfth Embodiment

Figure 20:
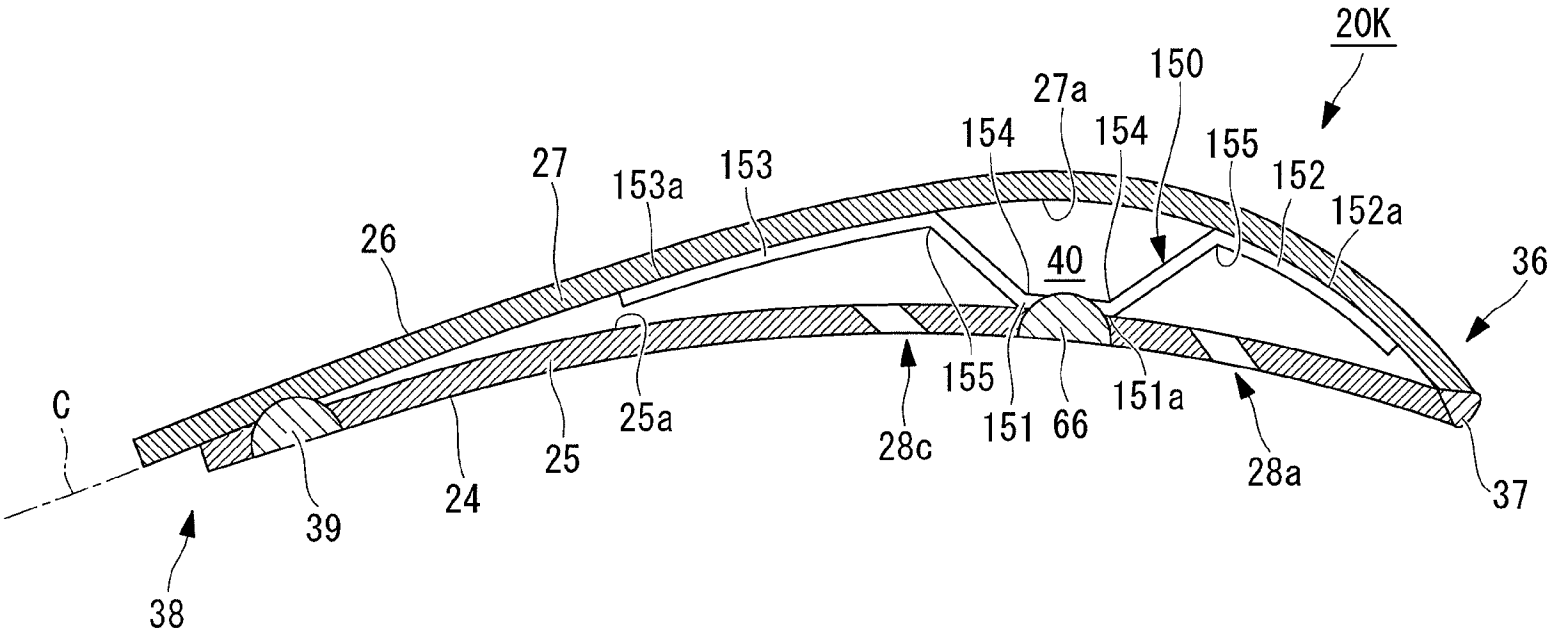
FIG. 20 is a view showing the blade shape of a stationary blade according to a twelfth embodiment.

A stationary blade according to this embodiment will be described using FIG. 20. FIG. 20 is a view showing the blade shape of a stationary blade. A stationary blade 20K according to this embodiment differs from the stationary blade 20H according to the tenth embodiment in that a bow-shaped plate spring 150 is provided instead of the bow-shaped plate spring 60. A detailed description will be given below. The configuration substantially in common with the stationary blade according to the tenth embodiment will be denoted by the same reference numerals, and a description thereof will be omitted.

As shown in FIG. 20, the bow-shaped plate spring 150 according to this embodiment has a first bent portion 154 and a second bent portion 155 between the base portion 151 and an end portion 152 and between the base portion 151 and an end portion 153. Furthermore, the base portion 151 is formed such that a surface 151*a* thereof has substantially the same curvature as the rear face 25*a* of the pressure-side member 25 and the end portions 152 and 153 are formed such that rear faces 152*a* and 153*a* thereof have substantially the same curvatures as the rear face 27*a* of the suction-side member 27.

In the stationary blade 20K according to this embodiment, because, when the bow-shaped plate spring 151 is incorporated into the cavity 40, the rear faces 152*a* and 153*a* of the end portions 152 and 153 of the bow-shaped plate spring 150 are in contact with the rear face 27*a* of the suction-side member 27 over a larger (wider) area, uneven contact of the plate spring caused by the dimensional tolerance of the plate spring and the dimensional tolerance of the blade (the pressure-side member 25 and the suction-side member 27) can be further prevented, and the surface pressure (pressing force per unit area) can be reduced. Thus, abrasion of the suction-side member 27 and the end portions 152 and 153 of the bow-shaped plate spring 150 can be reduced.

Because other functions and advantages are the same as those of the tenth embodiment, descriptions thereof will be omitted here.

In the above-described embodiments, although the pressure-side member 25 constitutes the pressure-side portion of the stationary blade 20 and the suction-side member 27 constitutes the suction-side portion of the stationary blade 20, the configurations of the pressure-side portion and suction-side portion are not limited thereto. As long as the stationary blade has a cavity formed between the pressure-side portion and the suction-side portion, the present invention may be applied to a stationary blade formed by, for example, flattening and curving a tubular member to form curves constituting the pressure-side face and suction-side face of the blade on the surfaces of the tubular member and a cavity in the tubular member.

Furthermore, although, in the above-described embodiments, the plate-like spring member (C-shaped plate spring 52; bow-shaped plate springs 60, 140, 141, and 150; angular U-shaped plate springs 70, 72, and 74) serving as the sliding-contact member is provided, the sliding-contact member is not limited thereto. For example, a plastic or rubber member may be used as long as it can be in sliding contact with the blade inner face from the cavity, or, as long as the rear faces of the base portions can be in sliding contact with each other.

Furthermore, although, in the above-described embodiments, the plate-like spring member (C-shaped plate spring 52; bow-shaped plate springs 60, 140, 141, and 150; angular U-shaped plate springs 70, 72, and 74) serving as the urging member is provided, the urging member is not limited thereto. For example, a coil spring may be used as long as it can urge the pressure-side portion and the suction-side portion outward in the blade-thickness direction.

Figure 21A:
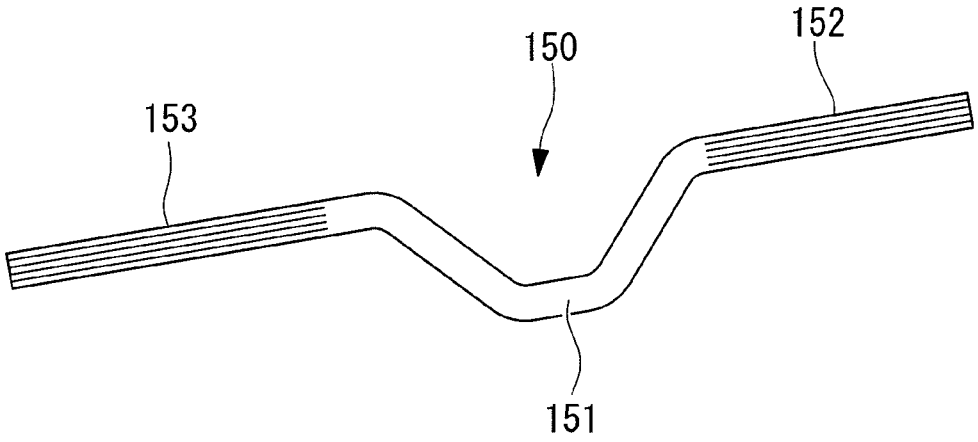
FIG. 21A is a side view showing another embodiment of a plate-like spring member.
Figure 21B:
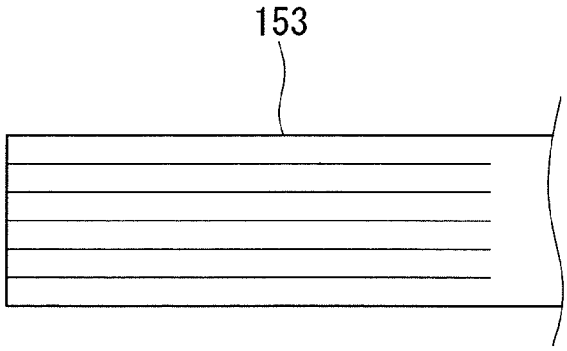
FIG. 21B is a view showing another embodiment of a plate-like spring member, showing the relevant part of FIG. 21A in an enlarged state.

Furthermore, in the above-described embodiments, it is more preferable that the end portions of the plate-like spring member (C-shaped plate spring 52; bow-shaped plate springs 60 and 150; angular U-shaped plate springs 70, 72, and 74) have a divided structure (or a slit structure), as shown in FIGS. 21A and 21B, in which the end is divided into a plurality of plates in the plate-thickness direction.

In the case where such a plate-like spring member is employed, when the stationary blade is elastically deformed, frictional attenuation is produced between divided plates. As a result, relative positional displacement between the pressure-side member 25 and the suction-side member 27 can be further attenuated and self-excited vibrations occurring at the stationary blade can be further reduced.

Note that FIGS. 21A and 21B show a concrete example in which the end portions 152 and 153 of the bow-shaped plate spring 150 have a divided structure.

Figure 22:
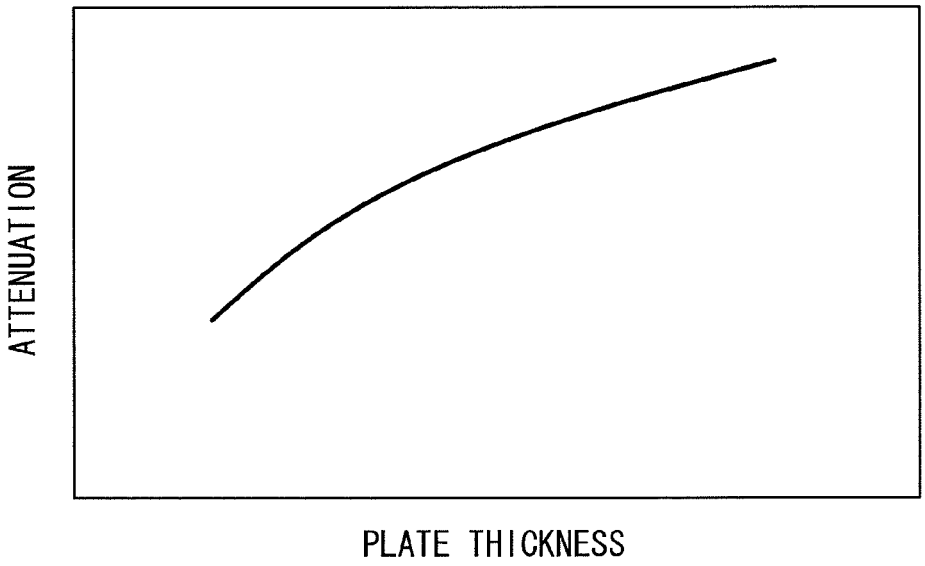
FIG. 22 is a graph showing the relationship between plate thickness and attenuation.

Furthermore, there is a relationship between the plate thickness and attenuation as shown in FIG. 22, that is, a characteristic in which an increase in the plate thickness (for example, an increase in the plate thickness from 1.2 mm to 1.5 mm or from 1.5 mm to 2 mm) also increases attenuation. Herein, "attenuation" means structural attenuation, material attenuation, and frictional attenuation that are put together.

Therefore, in the above-described embodiments, it is also possible to obtain a desired attenuation by changing (controlling) the thickness of the plate-like spring member (C-shaped plate spring 52; bow-shaped plate springs 60 and 150; and angular U-shaped plate springs 70, 72, and 74).

As has been described, the stationary blades according to the present invention are useful for steam turbines, and, in particular, they are suitable for low-pressure steam turbines that receive a supply of steam from a moisture separation heater.

The invention claimed is:

1. A stationary blade for use in a steam turbine, having a cavity formed therein and having a slit formed for communicating between the cavity and the outside, the stationary blade comprising:

a sliding-contact member capable of contacting a blade inner face from the cavity in a slidable manner;

a pressure-side portion, which is a portion on the pressure side of the cavity; and a suction-side portion, which is a portion on the suction side of the cavity, wherein the sliding-contact member is provided between the pressure-side portion and the suction-side portion and is in contact with at least one of the pressure-side portion and the suction-side portion, wherein the sliding-contact member is an urging member that urges the pressure-side portion and the suction-side portion outward in a blade-thickness direction, wherein the urging member is a plate-like spring member that has a plate shape extending in a blade-width direction and presses the pressure-side portion and the suction-side portion with an elasticity caused by distortion, wherein the plate-like spring member has a bow-shaped cross section and is in contact with one of the pressure-side portion and the suction-side portion at end portions of the bow shape and is in contact with the other at a base portion of the bow shape, and wherein an end portion of the plate-like spring member has a divided structure or a slit structure in which the end portion is divided into a plurality of plates in a plate thickness direction.

2. A steam turbine in which the stationary blades according to claim 1 are arranged at predetermined intervals in a circumferential direction of a rotor shaft.

3. The steam turbine according to claim 2, wherein solid stationary blades are arranged in a mixed manner.

4. The steam turbine according to the claim 3, wherein the stationary blades and the solid stationary blades are alternately arranged.

5. The steam turbine according to claim 2, wherein a plurality of types of stationary blades having different natural frequencies are arranged.

6. A stationary blade for use in a steam turbine, having a cavity formed therein and having a slit formed for communicating between the cavity and the outside, the stationary blade comprising:

a sliding-contact member capable of contacting a blade inner face from the cavity in a slidable manner;

a pressure-side portion, which is a portion on the pressure side of the cavity;

a suction-side portion, which is a portion on the suction side of the cavity; and a welded portion at which the pressure-side portion and the suction-side portion are connected to each other by welding, wherein the sliding-contact member is provided between the pressure-side portion and the suction-side portion and is in contact with at least one of the pressure-side portion and the suction-side portion, and wherein a base portion of the sliding-contact member is fixed to the at least one of the pressure-side portion and the suction-side portion by welding.

7. The stationary blade according to claim 6, wherein the sliding-contact member is an urging member that urges the pressure-side portion and the suction-side portion outward in a blade-thickness direction.

8. The stationary blade according to claim 7, wherein the urging member is a plate-like spring member that has a plate shape extending in a blade-width direction and presses the pressure-side portion and the suction-side portion with an elasticity caused by distortion.

9. The stationary blade according to claim 8, wherein the plate-like spring member has a wave-shaped cross section and is in contact with the pressure-side portion and the suction-side portion at crests of the wave shape.

10. The stationary blade according to claim 8, wherein the plate-like spring member has a substantially C-shaped cross section and is in contact with one of the pressure-side portion and the suction-side portion at open-end portions of the C shape and is in contact with the other at the base portion of the C shape.

11. The stationary blade according to claim 8, wherein the plate-like spring member has a bow-shaped cross section and is in contact with one of the pressure-side portion and the suction-side portion at end portions of the bow shape and is in contact with the other at the base portion of the bow shape.

12. The stationary blade according to claim 8, wherein the plate-like spring member has an angular U-shaped cross section and is in contact with the pressure-side portion and the suction-side portion at arm portions of the angular U shape.

13. The stationary blade according to claim 8, wherein, among cavities divided by the plate-like spring member, a cavity not communicating with the outside via a slit is provided with a damping material.

14. A stationary blade for use in a steam turbine, having a cavity formed therein and having a slit formed for communicating between the cavity and the outside, the stationary blade comprising:

a sliding-contact member capable of contacting a blade inner face from the cavity in a slidable manner;

a pressure-side portion, which is a portion on the pressure side of the cavity;

a suction-side portion, which is a portion on the suction side of the cavity; and a welded portion at which the pressure-side portion and the suction-side portion are connected to each other by welding, wherein the sliding-contact member is provided between the pressure-side portion and the suction-side portion and is in contact with at least one of the pressure-side portion and the suction-side portion, wherein the sliding-contact member is an urging member that urges the pressure-side portion and the suction-side portion outward in a blade-thickness direction, wherein the urging member is a plate-like spring member that has a plate shape extending in a blade-width direction and presses the pressure-side portion and the suction-side portion with an elasticity caused by distortion, wherein the plate-like spring member has a bow-shaped cross section and is in contact with one of the pressure-side portion and the suction-side portion at end portions of the bow shape and is in contact with the other at a base portion of the bow shape, and wherein an end portion of the plate-like spring member has a divided structure or a slit structure in which the end portion is divided into a plurality of plates in a plate-thickness direction.

* * * * *